US007722245B2

(12) United States Patent
Baba et al.

(10) Patent No.: US 7,722,245 B2
(45) Date of Patent: May 25, 2010

(54) DISPLAY DEVICE

(75) Inventors: Norimitsu Baba, Shiojiri (JP); Yutaka Kawafune, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 313 days.

(21) Appl. No.: 11/859,401

(22) Filed: Sep. 21, 2007

(65) Prior Publication Data

US 2008/0084657 A1 Apr. 10, 2008

(30) Foreign Application Priority Data

Oct. 6, 2006 (JP) ..... 2006-275848
Feb. 1, 2007 (JP) ..... 2007-023365

(51) Int. Cl.
*A44C 5/00* (2006.01)

(52) U.S. Cl. ..... 368/281; 368/82

(58) Field of Classification Search ..... 368/276–284, 368/82

See application file for complete search history.

(56) References Cited

U.S. PATENT DOCUMENTS 5,872,744 A * 2/1999 Taylor ..... 368/13
6,216,490 B1 * 4/2001 Radley-Smith ..... 63/3
6,621,766 B2 * 9/2003 Brewer et al. ..... 368/82
7,460,085 B2 * 12/2008 Ishii ..... 345/1.1
2004/0156270 A1 8/2004 Weng
2005/0174302 A1 8/2005 Ishii
2008/0037374 A1 * 2/2008 Chu et al. ..... 368/82

FOREIGN PATENT DOCUMENTS

JP 2005-060215 A 3/2005
JP 2005-250442 A 9/2005
WO WO-00/59327 A1 10/2000
WO WO-2004/068990 A1 8/2004

* cited by examiner

*Primary Examiner*—Renee S Luebke
*Assistant Examiner*—Sean Kayes
(74) *Attorney, Agent, or Firm*—Global IP Counselors, LLP

(57) ABSTRACT

A display device has a frame having a substantially cylindrically shaped cylindrical part, a display panel that is band shaped and flexible, and a spacer that is substantially cylindrically shaped and is fit to the cylindrical part. The display panel is disposed to the outside surface of the spacer.

12 Claims, 19 Drawing Sheets

DISPLAY DEVICE

BACKGROUND

1. Field of Invention

The present invention relates to a display device. More particularly, the invention relates to a display device that is basically tubular and has a display panel disposed along the outside circumference.

2. Description of Related Art

Tubular display devices that are worn on the wrist, for example, are known from the literature. The frame of the display device may have a thin display panel such as an electrophoretic display panel disposed along the outside circumference surface of the frame as taught in Japanese Unexamined Patent Appl. Pub. JP-A-2005-250442.

The display panel (display unit) of the display device taught in JP-A-2005-250442 is connected to a flexible printed circuit that is populated with the electronic components for driving the display device by a connector unit. The display panel and flexible printed circuit are folded together at the connector unit. The flexible printed circuit is disposed directly on the outside surface of the bobbin-shaped frame, and the display panel is disposed above the outside of the flexible printed circuit with a gap therebetween so that the flexible printed circuit is between the display panel and the frame.

If the electrophoretic display panel or other thin display panel is distorted, however, the distortion can degrade the image quality. It is therefore necessary in a display device that has a thin display panel disposed around the outside surface to install the display panel in a stable manner without applying unnecessary force.

In the display device taught in JP-A-2005-250442 the display panel must be rendered so that it is stable and substantially annular even though the display panel is floating above the flexible printed circuit. This can be done, for example, by holding the opposite edges of the display panel between a pair of rails disposed around the entire circumference of the frame. Because the restoring force of the display panel bent into a ring is suppressed by the rails disposed around the circumference of the frame, the display panel is easily distorted and image quality may be degraded.

SUMMARY

The display device of the invention reduces the fixed parts of the display panel and stably disposes the display panel substantially in a ring.

A display device according to a preferred aspect of the invention has a frame having a substantially cylindrically shaped cylindrical part, a display panel that is band shaped and flexible, and a spacer that is substantially cylindrically shaped and is fit to the cylindrical part. The display panel is disposed to the outside surface of the spacer.

Examples of such a display device are a wristwatch and a cell phone, and examples of a band-shaped display panel are an electrophoretic display panel and an organic electroluminescent (EL) panel.

The display panel in this aspect of the invention is disposed around the outside surface of the substantially cylindrical spacer. Because the bottom of the display panel is in contact with the spacer, the display panel can be disposed in a stable condition and can be disposed in a substantially annular shape.

Furthermore, because the bottom of the display panel is in contact with the spacer, the display panel can be disposed in a stable condition by simply securing both end parts of the display panel with double-sided tape, for example. The display panel can also be disposed with only a small portion of the display panel affixed. The force applied by securing the display panel can also be reduced and distortion can be reduced. The drive circuit unit for driving the display panel (corresponding to the flexible printed circuit in JP-A-2005-250442) can be held between the spacer and the cylindrical part, for example.

The spacer in the display device of the invention preferably has a non-contiguous break in one part in the circumferential direction and is elastically deformable.

If the spacer must be forcibly fit to the cylindrical part because the spacer and the cylindrical part of the frame fit too tightly due to variations in manufacture, the spacer can become distorted, thus also distorting the display panel and possibly degrading the image quality. The spacer could also be cracked if the spacer is fit with excessive force.

By forming a break at one part in the circumferential direction of the spacer and making the spacer elastically deformable, the invention enables spreading the gap at the break. This enables easily fitting the spacer to the cylindrical part if manufacturing variations cause the spacer to fit too tightly to the cylindrical part. Distortion of the spacer and therefore the display panel due to forcibly fitting the spacer to the cylindrical part can thus be reduced. Cracking of the spacer can also be prevented.

Furthermore, because a break is formed at one part in the circumferential direction of the spacer and the spacer is elastically deformable, the spacer can absorb the force of impact and vibrations that are applied when the display device is dropped, for example, and the effect of impact and vibration on the display device can be reduced.

Further preferably, the display device also has a holding part that is disposed to the outside surface of the spacer and has a pair of channels for slidably holding each lengthwise end part of the display panel. The display panel is held with substantially the middle part between the lengthwise ends adhesively attached to the spacer and both lengthwise ends held in the holding part.

Methods of adhesively attaching the middle part of the display panel to the spacer include using double-sided tape and using an adhesive.

If the holding parts having a pair of channels are formed around the entire circumference of the spacer, the display panel will be constrained around the entire circumference as it tries to return to its original shape after being deformed into a circle. The display panel is easily distorted in this case, and the image quality may be degraded.

The holding parts of the invention secure the display panel at both end parts and in the middle, and leave the portions between the end parts and the middle free. As a result, if compressive force is applied to the portion between the end parts and the middle, this portion can bend and distortion can therefore be suppressed.

In addition, if only both end parts of the display panel are secured, the restoring force of the display panel tends to cause particularly the middle part of the display panel to separate from the spacer. The invention secures both the end parts and the middle, however, can therefore dispose the display panel sufficiently tightly to the spacer, and thus holds the display panel in a more stable condition.

Furthermore, because the middle part is adhesively affixed to the spacer, the force pressing on the display panel can be reduced and distortion can be more effectively suppressed compared with securing the middle part of the display panel to the spacer by means of a holding part having channels.

Further preferably, the display device has a panel abutment part that is abutted by one lengthwise end of the display panel disposed to the outside surface of the spacer, and a gap that connects the inside with the outside of the spacer and enables inserting the other lengthwise end of the display panel.

When a break is rendered at one part in the circumferential direction of the spacer, this gap that connects the inside with the outside of the spacer and enables inserting the other lengthwise end of the display panel can be a gap rendered between the circumferential ends of the space or the gap can be a slit formed in the spacer.

Because this aspect of the invention has a panel abutment part, the display panel can be easily positioned to the spacer and therefore to the frame by simply setting one end of the display panel against the abutment.

Furthermore, because a gap enabling inserting the display panel is rendered in the spacer, if variations in manufacture result in the display panel being slightly too long, the excess length portion can be inserted to this gap and disposed in this gap and between the spacer and the cylindrical part. The display panel can therefore be disposed more tightly to the spacer.

Yet further preferably, the display device has a protruding part that is disposed projecting to the outside on the outside surface of the cylindrical part of the frame, and a groove that can hold the protruding part and is disposed to the inside circumference surface of the spacer at a position corresponding to the protruding part.

Because a groove that can hold the protruding part is disposed to the inside circumference surface of the spacer at a position corresponding to the protruding part in this aspect of the invention, the spacer and therefore the display panel can be easily positioned to the frame by simply fitting the protruding part into the groove.

Furthermore, because the groove is disposed to the inside surface of the spacer, the spacer can be opened more easily when a break is provided in the spacer, and the spacer can therefore be even more easily fit to the cylindrical part.

In a display device according to another aspect of the invention the frame has a body and a cover part, the body includes the cylindrical part and a flange part that projects to the outside from one axial end side of the cylindrical part, a plurality of the protruding parts are disposed to the other axial end side of the cylindrical part and a screw hole is formed in each of the protruding parts, and the cover part is flat, has holes formed at positions corresponding to each of the screw holes, and is secured by screws on the other end side of the cylindrical part where the protruding parts are formed so that the cover part opposes the flange part.

These screw holes can be screw holes that do not pass through the protruding parts, or screw holes (holes) that pass through.

In this aspect of the invention the protruding parts function both for positioning the spacer and for securing the cover part, and thus afford a simpler arrangement.

The display device according to another aspect of the invention also has a battery that is the drive power source for the display panel. The display panel is disposed around substantially the entire circumference on the outside surface of the spacer, both end parts of the display panel in the circumferential direction are disposed separated by a prescribed distance, and the battery is disposed between the end parts of the display panel.

The battery is a button battery or other primary battery, or a rechargeable secondary battery. The gap between the ends of the display panel is at least large enough to hold the battery, but the gap is preferably as small as possible in order to maximize the display area of the display panel.

This aspect of the invention disposes the battery between the circumferential ends of the display panel wrapped around the outside circumference surface of the frame, and the display panel and the battery therefore do not overlap. The thickness in the part where the display panel and the battery are located can therefore be reduced compared with an arrangement in which the display panel and the battery overlap, and a thinner design can therefore be achieved.

Yet further preferably, the display device has a cover member that covers at least the battery.

The area covered by the cover member at least includes the entire battery. The cover member may also cover the gaps between the ends of the display panel and the battery. The cover member may also cover both ends of the display panel.

Because the cover member in this aspect of the invention covers at least the battery, the battery that is desirably not exposed for aesthetic reasons can be hidden, decorativeness can be improved, and a pleasing appearance can be achieved.

The shape of the cover member preferably conforms to the outside surface of the frame. If an inflexible battery such as a button battery is located in the surface of the frame, the battery cannot be curved to follow the surface shape of the frame. However, by covering the battery with a cover member that conforms to the shape of the frame, a uniform appearance can be achieved over the entire surface of the frame.

Yet further preferably, the display device also has a cover member position indication part for positioning the cover member disposed to the display panel, and the cover member position indication part can be displayed when positioning the cover member.

Because this arrangement has a cover member position indication part disposed to the display panel, the cover member position indication part can be illuminated during assembly for aligning the ends of the cover member with the cover member position indication part. The cover member can therefore be easily positioned. Assembly is therefore more efficient.

After positioning the cover member is completed the cover member position indication part can be turned off so that the cover member position indication part is not exposed and a good appearance can be achieved.

Yet further preferably, the display device also has a protruding part that is disposed to the spacer and enables positioning the cover member by contacting the cover member.

Because this aspect of the invention has a protruding part that is disposed to the spacer and enables positioning the cover member by contacting the cover member, the cover member can be easily positioned in a short time during assembly and assembly is therefore more efficient.

In the display device according to another aspect of the invention the cover member has a photoelectric conversion means for converting light energy to electrical energy, and the battery is a secondary cell that stores the electrical energy output by the photoelectric conversion means.

Because the cover member is a photoelectric conversion means and the battery is a secondary battery in this aspect of the invention, electrical energy can be constantly supplied even if the electrical energy stored in the secondary battery is supplied to other parts because the electrical energy newly produced by the photoelectric conversion means can be stored in the secondary battery. Compared with an arrangement that uses a primary battery, this arrangement eliminates the need to regularly replace the battery and thereby reduces the burden on the user. There are also no depleted waste batteries to throw away, and the display device is therefore environmentally friendly.

In the display device according to another aspect of the invention the frame has a body and a cover part, the body includes the cylindrical part and a flange part that projects to the outside from one axial end side of the cylindrical part, the cover part is flat, has an opening that is the same size and the same shape as the shape of the end part of the cylindrical part, has an outside circumference shape that is the same size and the same shape as the outside circumference shape of the flange part, and can be removably attached to the other end of the cylindrical part opposite the flange part, a cylindrical transparent member is disposed to the outside surface of the display panel, the transparent member is held between the flange part and the cover part, and the battery is located between the cylindrical part and the transparent member and is disposed so that the battery can be moved toward the cover part and replaced by removing the cover part.

In this aspect of the invention the battery is located between the cylindrical part of the body and the transparent member and is disposed so that the battery can be moved toward the cover part and replaced by removing the cover part. The battery can therefore be easily replaced. Furthermore, because removing the transparent member is not necessary to replace the battery, dust, lint, and other foreign matter can be prevented from getting inside the frame.

The display device according to another aspect of the invention also has a cover member that covers at least the battery, the frame has a body and a cover part, the body includes the cylindrical part and a flange part that projects to the outside from one axial end side of the cylindrical part, the cover part is flat, has an opening that is the same size and the same shape as the shape of the end part of the cylindrical part, has an outside circumference shape that is the same size and the same shape as the outside circumference shape of the flange part, and can be removably attached to the other end of the cylindrical part opposite the flange part, a cylindrical transparent member is disposed to the outside surface of the display panel, the spacer and the transparent member are held between the flange part and the cover part, and the cover member is covered by the transparent member.

By covering the display panel and the cover member with the transparent member, the display panel and the cover member in this aspect of the invention are reliably secured and protected from scratching and soiling.

Furthermore, because the spacer, the display panel, and the transparent member that are disposed on the outside of the cylindrical part of the body are held between the flange part and the cover part of the body, the spacer, the display panel, and the transparent member can be reliably secured to the frame and can be easily assembled.

The display device of the invention can reduce the fixed parts of the display panel and can stably dispose the display panel substantially in a ring.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
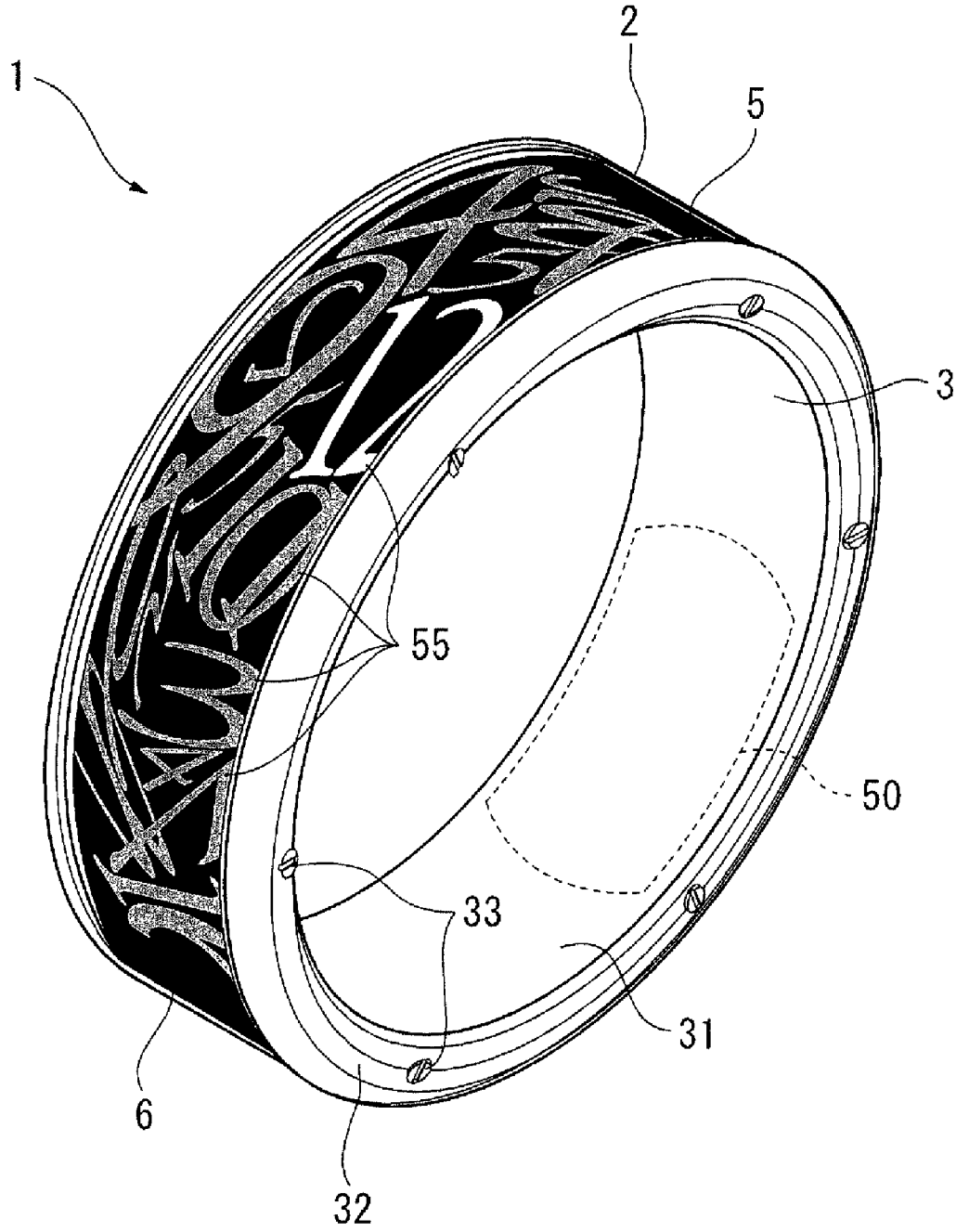
FIG. 1 is an oblique view showing a timepiece as a display device according to a first embodiment of the invention.

Preferred embodiments of the present invention are described below with reference to the accompanying figures.

Note that in the second and subsequent embodiments described below parts that are the same as or functionally similar to equivalent parts in the first embodiment are identified by the same reference numerals and further description thereof is simplified or omitted.

Embodiment 1

1. General Configuration

FIG. 1 is an oblique view of a timepiece 1 according to a first embodiment of the invention. The timepiece 1 described below as a display device according to the present invention is a bracelet type timepiece that is formed in a ring as shown in FIG. 1 and is worn on the wrist. An electrophoretic display panel 5 for displaying the time and date is disposed around the entire circumference on the outside of the timepiece 1.

Figure 2:
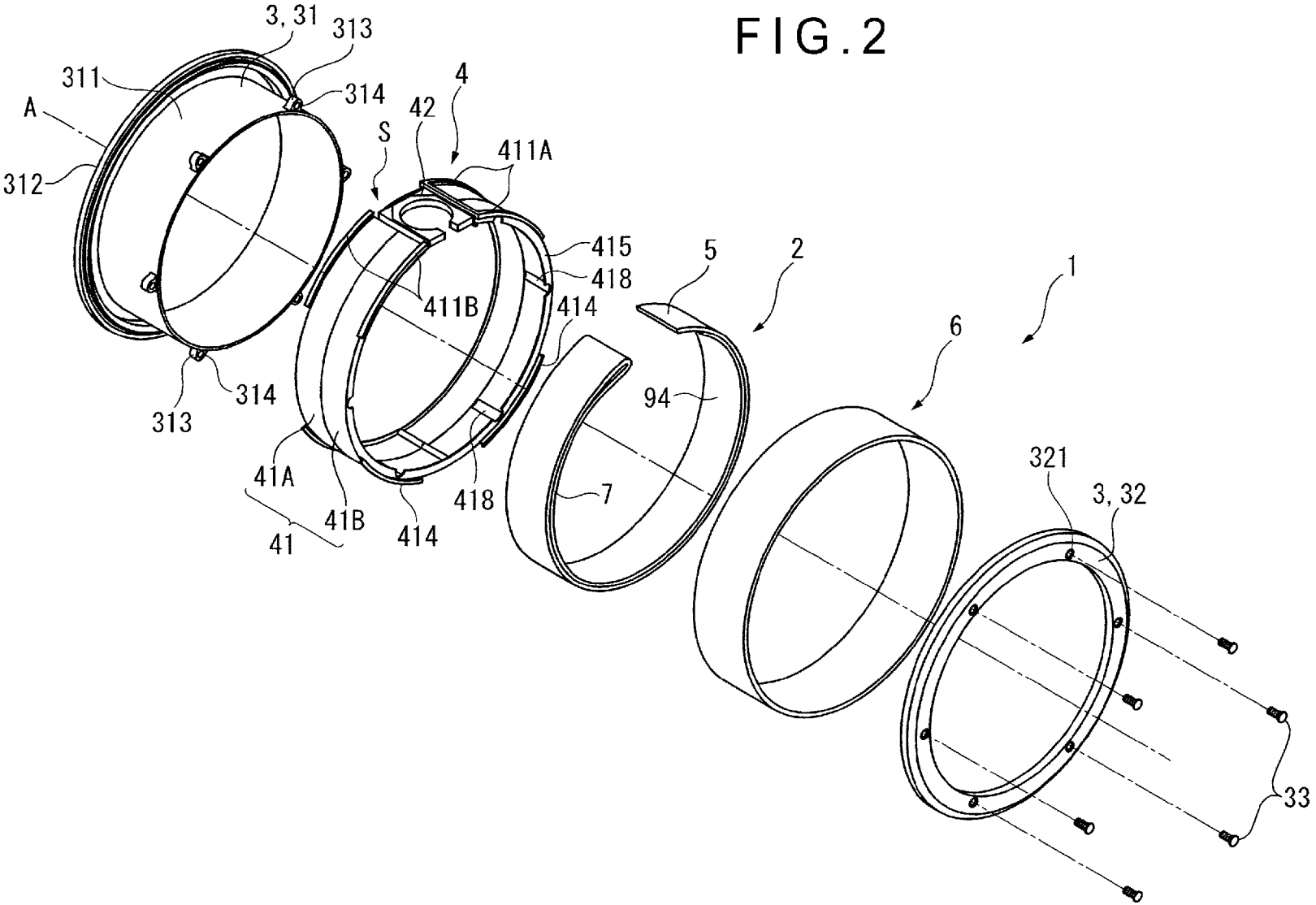
FIG. 2 is an exploded oblique view of the timepiece in this embodiment of the invention.

FIG. 2 is an exploded oblique view of the timepiece 1.

As shown in FIG. 2 the timepiece 1 includes a substantially annular frame 3, a substantially annular spacer 4 that fits onto the frame 3, a display module 2 disposed to the spacer 4, and a glass crystal 6 as an annular transparent member. The spacer 4 has the display panel 5 and a switching circuit board 94. The display panel 5 is covered by the glass crystal 6. The axis A in FIG. 2 is the virtual center axis of the frame 3, the spacer 4, the display module 2, and the glass crystal 6.

As shown in FIG. 2 the frame 3 includes a body 31 and a back cover 32 as a cover member.

The body 31 includes a cylindrical part 311 as a body tube, and a flange 312 that protrudes radially from one end edge of the cylindrical part 311 so that the body 31 is L-shaped when seen in section.

A plurality of protrusions 313 project radially to the outside from the other end edge of the cylindrical part 311. A screw hole 314 is formed in each of the protrusions 313.

The back cover 32 is formed from a flat member with an inside circumference shape (an opening) that is the same size and shape as the inside circumference shape of the cylindrical part 311, and an outside circumference shape that is the same size and shape as the outside circumference shape of the flange 312. Holes 321 are formed at positions corresponding to the screw holes 314 in the protrusions 313. The back cover 32 is fastened to the cylindrical part 311 by a plurality of screws 33 that are screwed through the holes 321 into the screw holes 314.

As described in further detail below, after the display module 2 is assembled to the spacer 4, the spacer 4 is fit to the frame 3 and is held between the back cover 32 and the flange 312.

The glass crystal 6 is held between the back cover 32 and the flange 312 and covers the display panel 5.

2. Arrangement of the Display Module and the Drive Circuit Unit

Figure 3:
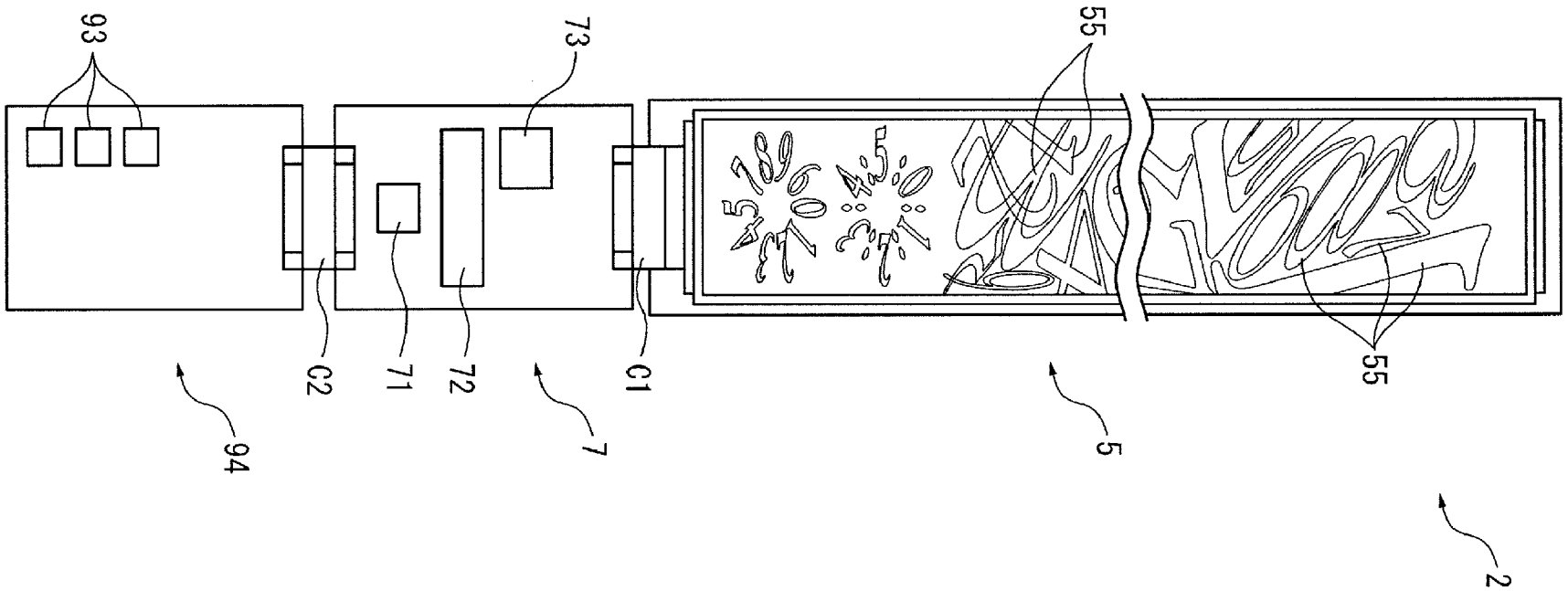
FIG. 3 is a plan view of a display module in this embodiment of the invention.
Figure 4:
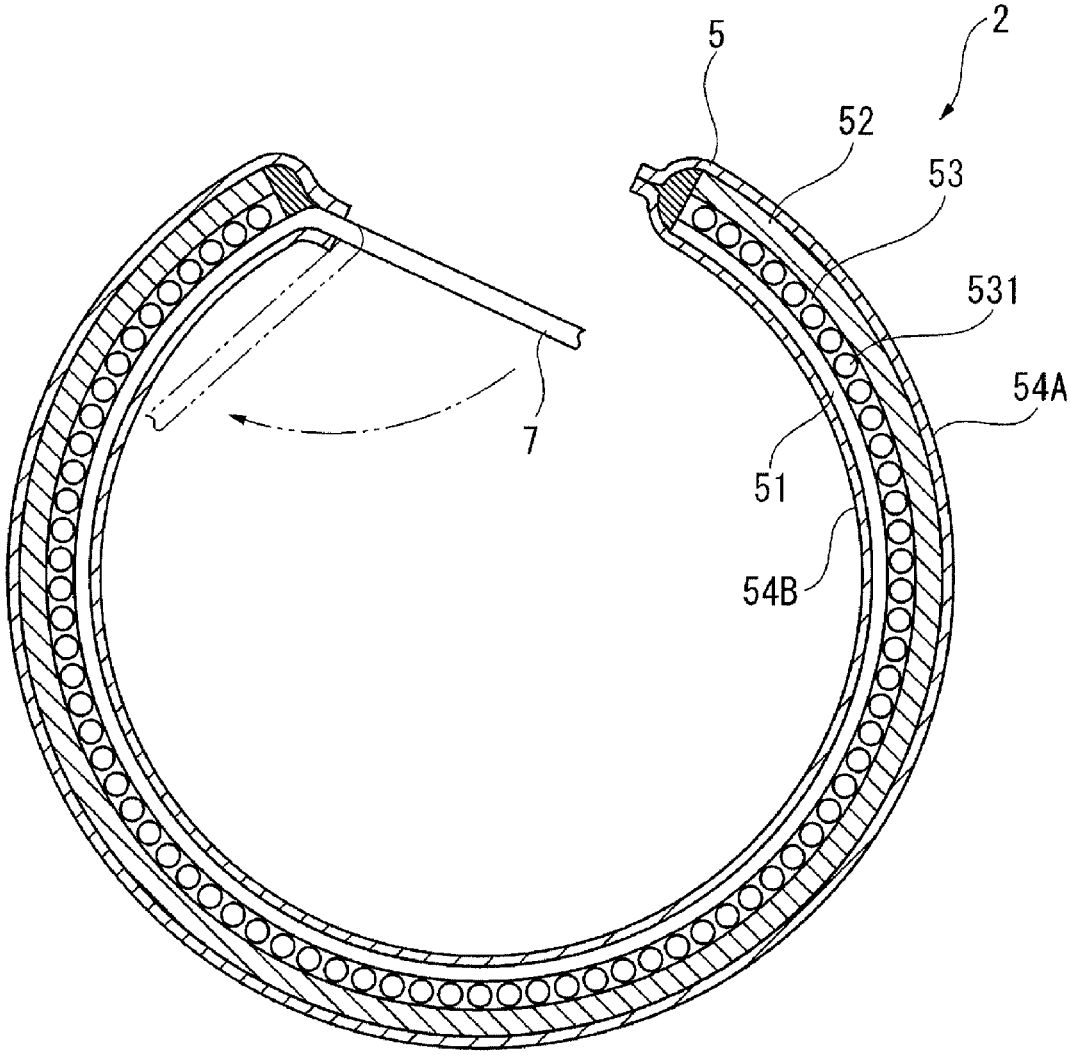
FIG. 4 is a section view of the display module in this embodiment of the invention.

FIG. 3 is a plan view of the display module 2, and FIG. 4 is an end section view of the display module 2. Note that the drive circuit unit 7 and the switch circuit 94 are drawn shorter in FIG. 3 and FIG. 4 than in FIG. 2.

As shown in FIG. 3 the display module 2 includes the drive circuit unit 7, the switch circuit 94 that sends input signals to the drive circuit unit 7, and the display panel 5 that is driven and controlled by the drive circuit unit 7 to display the time, for example. A tactile switch 93 is disposed to the switch circuit 94 so that the tactile switch 93 is depressed when the operator presses an operating button 91 (see FIG. 11) and the switch circuit 94 sends an input signal to the drive circuit unit 7. The drive circuit unit 7, the switch circuit 94, and the display panel 5 are manufactured separately. The drive circuit unit 7 and the display panel 5 are connected by a wiring member C1 such as an anistropic conductive film (ACF), and the drive circuit unit 7 and the switch circuit 94 are connected by an identical wiring member C2. The drive circuit unit 7 and the switch circuit 94 are flexible printed circuits that are made from polyimide, polyester, or other flexible plastic material.

As shown in FIG. 3 and FIG. 4, the display module 2 is folded over at the wiring member C1 connecting the display panel 5 to the drive circuit unit 7. As indicated by the double-dot dash line in FIG. 4, the drive circuit unit 7 is folded over to the back of the display panel 5. As shown in FIG. 3, the drive circuit unit 7 has a controller 71 for controlling the timepiece 1, a driver IC 72 as the drive device of the display panel 5, and a crystal oscillation circuit element 73.

3. Arrangement of the Electrophoretic Display Panel

As shown in FIG. 4 the display panel 5 includes a display circuit 51, a transparent circuit 52, and an electrophoretic layer 53 disposed between the display circuit 51 and the transparent circuit 52. The display circuit 51 and the transparent circuit 52 are also flexible printed circuits made from polyimide, polyester, or other flexible plastic material. As shown in FIG. 4 this display panel 5 is curved substantially 360° substantially into a circle so that the opposite ends are separated a prescribed distance from each other.

As shown in FIG. 4, the display circuit 51 is thinner than the transparent circuit 52. A plurality of microcapsules 531 are bonded to the top part of the display circuit 51.

Moisture resistant sheets 54A and 54B are disposed to the top and the bottom sides of the transparent circuit 52. These moisture resistant sheets 54A and 54B seal the display panel 5 and prevent water from penetrating to the electrophoretic layer 53.

More specifically, the inside surfaces of the moisture resistant sheets 54A and 54B are coated with a hot melt adhesive layer, the ends of the moisture resistant sheets 54A and 54B are bonded using a vacuum laminator, for example, and the moisture resistant sheets 54A and 54B are bonded to the transparent circuit 52 and the display circuit 51, thereby sealing the transparent circuit 52, the electrophoretic layer 53, and the display circuit 51 at the ends and top and bottom surfaces of the circuits.

Figure 5:
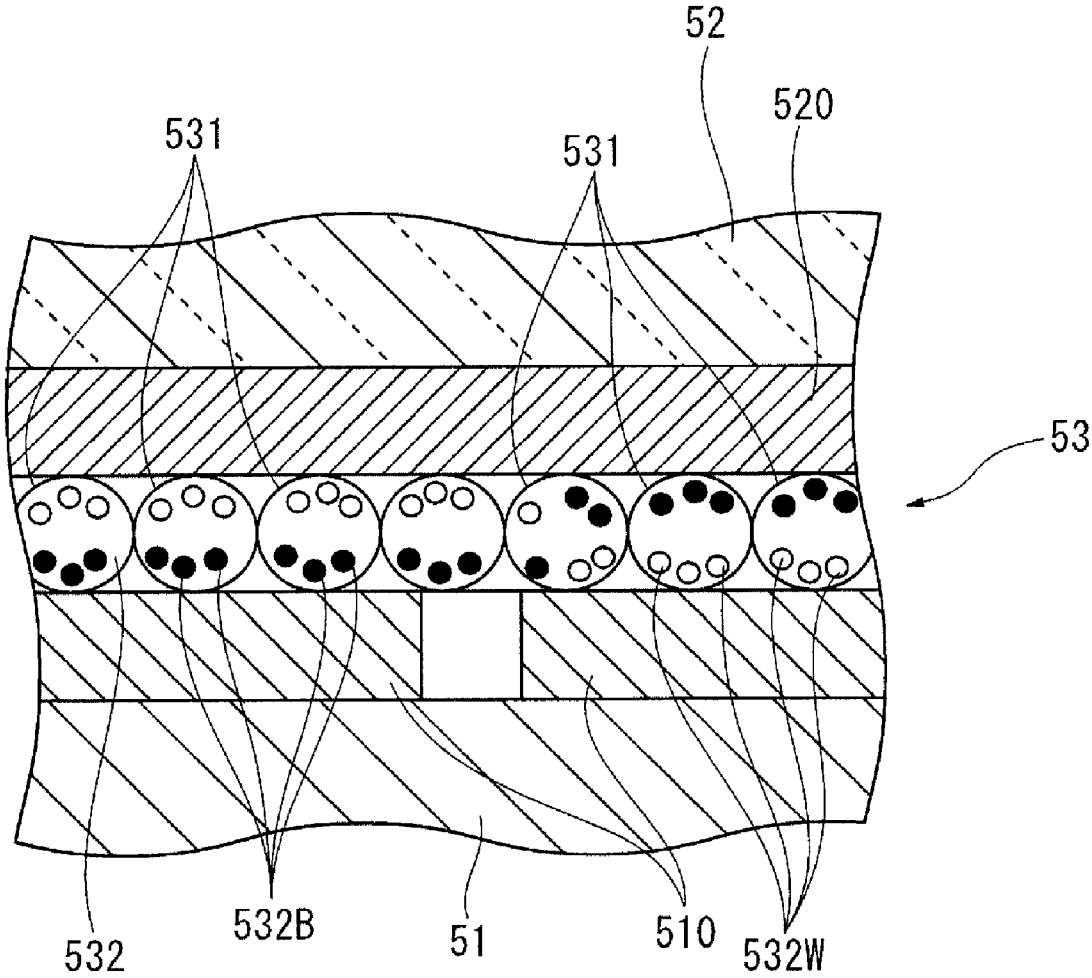
FIG. 5 is a schematic view showing the display panel in this embodiment of the invention.

FIG. 5 is a schematic section view showing the arrangement of the display panel 5.

As shown in FIG. 5 segment electrodes 510 of the same shape as the segments 55 (see FIG. 3) are disposed on the top surface of the display circuit 51 at positions corresponding to each of the segments 55.

A transparent common electrode 520 made of indium tin oxide (ITO), for example, is disposed over substantially the entire back surface of the transparent circuit 52 (the side facing the display circuit 51). The common electrode 520 is an electrode that is common to each of the segment electrodes 510.

The electrophoretic layer 53 is rendered by a dense distribution of numerous microcapsules 531 as shown in FIG. 5. Each of the microcapsules 531 is filled with an electrophoretic particle suspension 532 in which numerous charged particles are dispersed. Black electrophoretic particles 532B ("black particles" below) and white electrophoretic particles 532W ("white particles" below) that are charged to the opposite polarity as the black particles are dispersed in the electrophoretic particle suspension 532. In this embodiment of the invention the black particles 532B are positively charged and the white particles 532W are negatively charged.

When the particles are charged as described above and the common electrode 520 is driven to a high level potential (H potential), a field flowing from the common electrode 520 to the segment electrodes 510 is produced by the potential difference in the segments 55 for which the segment electrodes 510 is driven to a low level potential (L potential). This causes the positively charged black particles 532B to migrate to the segment electrodes 510 and the negatively charged white particles 532W to migrate to the common electrode 520 so that the segment 55 is white.

No field is produced in the segments 55 where the potential of the segment electrodes 510 is equal to the potential of the common electrode 520, and the display color therefore does not change.

When the common electrode 520 then goes to a low level (L potential), a field flowing in the opposite direction is produced in the segments 55 for which the segment electrodes 510 are a high level (H potential). This causes the negatively charged white particles 532W to migrate to the segment electrodes 510 and the positively black particles 532B to migrate to the common electrode 520 so that the segment 55 is black.

As noted above, no field is produced in the segments 55 where the potential of the segment electrodes 510 is equal to the potential of the common electrode 520, and the display color therefore remains the same.

Migration of the black particles 532B and the white particles 532W can be adjusted by adjusting the time the voltage is applied and the applied voltage so that intermediate colors between black and white can be displayed.

Images can thus be formed on the display panel 5 by changing the color displayed in each of the segments 55.

4. Arrangement of the Spacer

The spacer 4 is for disposing the display panel 5 in a stable, substantially annular state. The spacer 4 is plastic. As shown in FIG. 2, the spacer 4 includes a spacer body 41 that is non-contiguous in part circumferentially and is flexibly deformable, and a holder retaining part 42 rendered in unison with the spacer body 41 on one end in the circumferential direction of the spacer body 41.

5. Arrangement of the Spacer Body

Figure 6:
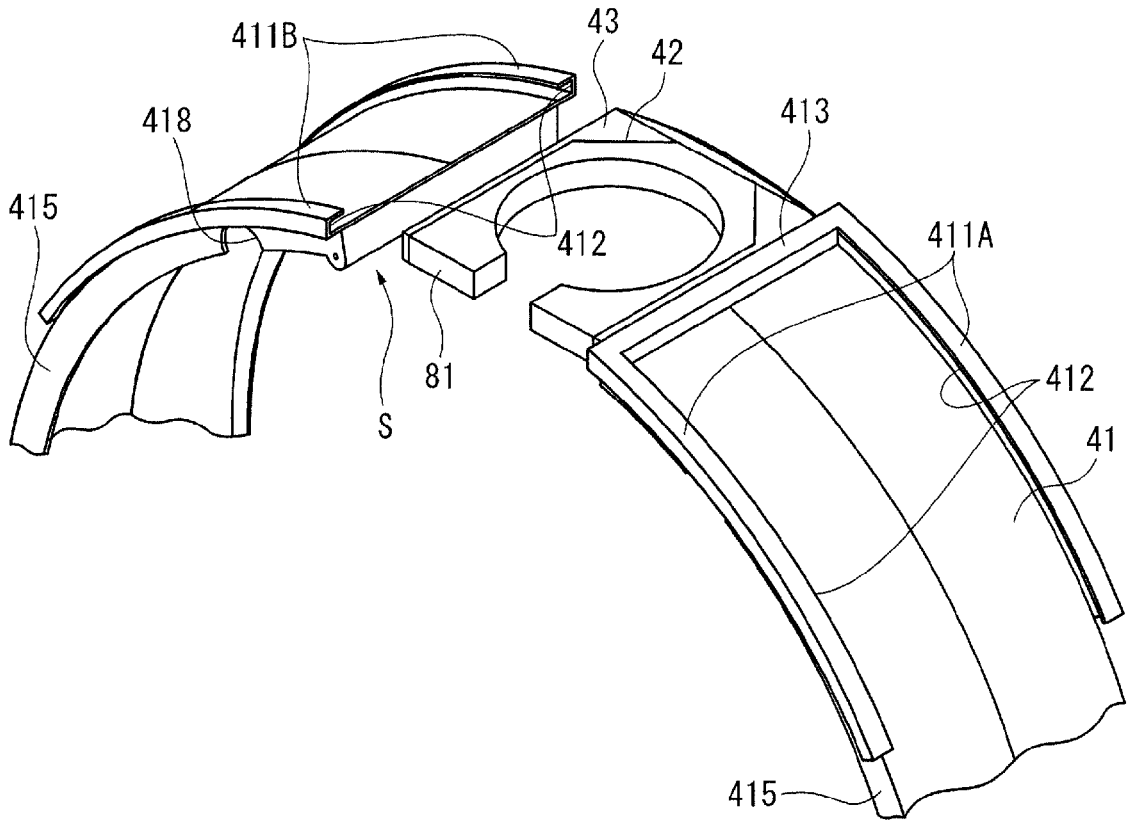
FIG. 6 is an enlarged view of the holding parts of the spacer in this embodiment of the invention.

FIG. 6 is an enlarged view of the holding parts 411A, 411B of the spacer 4.

As shown in FIG. 6, a first holding part 411A is disposed to both sides of one end of the spacer body 41 in which the holder retaining part 42 is disposed. A pair of channels 412 for slidably holding the distal end of the display panel 5 is formed in the first holding part 411A.

Note that herein the proximal end of the display panel 5 means the end that is connected to the drive circuit unit 7, and the distal end means the end that is not connected to the drive circuit unit 7.

A panel abutment 413 that joins the distal ends of the first holding part 411A rises across the width of the one end of the spacer body 41. This panel abutment 413 contacts the distal end of the display panel 5 when the display panel 5 is inserted and thus positions the display panel 5.

A second holding part 411B having a pair of channels 412 for slidably holding the proximal end of the display panel 5 is disposed at the other end of the spacer body 41.

As shown in FIG. 2, guide parts 414 for guiding the display panel 5 are disposed opposite the holding parts 411A, 411B on the outside circumference of the spacer body 41. Ribs 415 that reinforce the spacer body 41 are disposed around substantially the entire circumference of the spacer body 41. The ribs 415 form a storage space X (see FIG. 8) between the spacer body 41 and the cylindrical part 311. The drive circuit unit 7 and the button input unit 9 including the switch circuit 94 as described below are disposed in the storage space X.

As shown in FIG. 6, a battery holder 81 is stored in the holder retaining part 42 so that the battery holder 81 can slide parallel to the width of the spacer 4. A primary battery 10 described below is stored in this battery holder 81. The battery holder 81 and the primary battery 10 render the battery storage unit 8 described below.

A gap S sized to enable inserting the display module 2 is formed between the holder retaining part 42 and the other end of the spacer body 41 where the second holding part 411B is formed as shown in FIG. 6. The spacer 4 is thus non-contiguous at one part in the circumferential direction and a long, narrow gap S enabling inserting the display module 2 is formed at this break in the spacer 4.

As described above, the distal end of the display panel 5 is held by the first holding part 411A and the proximal end of the display panel 5 is held by the second holding part 411B. The middle part of the display panel 5 is adhesively affixed to the spacer body 41 by double-sided tape T1 (see FIG. 7) applied to the spacer body 41. The display panel 5 can therefore be disposed in a ring along the outside surface of the basically tubular spacer body 41. The display panel 5 can also be disposed in a stable condition by pressing substantially the entire bottom surface of the display panel 5 at the double-sided tape T1 to the spacer body 41.

Furthermore, because only both edge parts and the middle part of the display panel 5 are fixed, the force applied to the display panel 5 when the display panel 5 is affixed can be reduced and distortion can be prevented.

Furthermore, because the middle part is adhesively secured with double-sided tape T1, the force pressing on the display panel 5 can be reduced in comparison with securing the middle part by means of the channels 412 in the holding parts 411A, 411B, and distortion can be further reduced.

The part of the display module 2 below the part that is held by the second holding part 411B is folded back at the part in the gap S in the spacer 4 and is stored in the storage space X in the bottom of the spacer body 41. By thus rendering this gap S in the spacer 4, any portion of the display panel 5 that is slightly longer than the outside surface of the spacer body 41 due to manufacturing variations can be disposed in this gap S formed in the spacer 4 and the storage space X in the bottom of the spacer body 41, and the display panel 5 can therefore be disposed more tightly to the spacer body 41.

Figure 7:
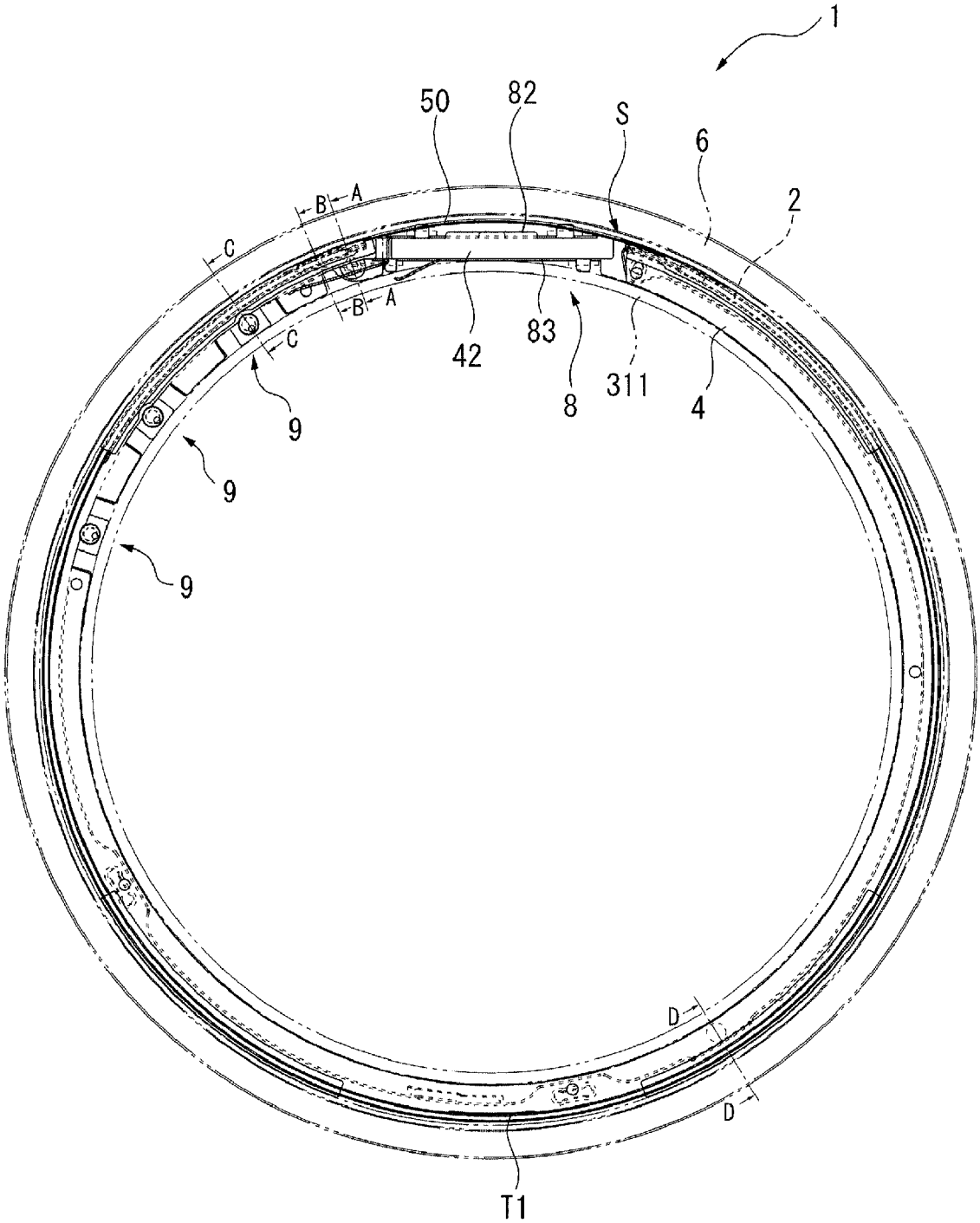
FIG. 7 is a side section view of the timepiece from the flange side part in this embodiment of the invention.
Figure 8:
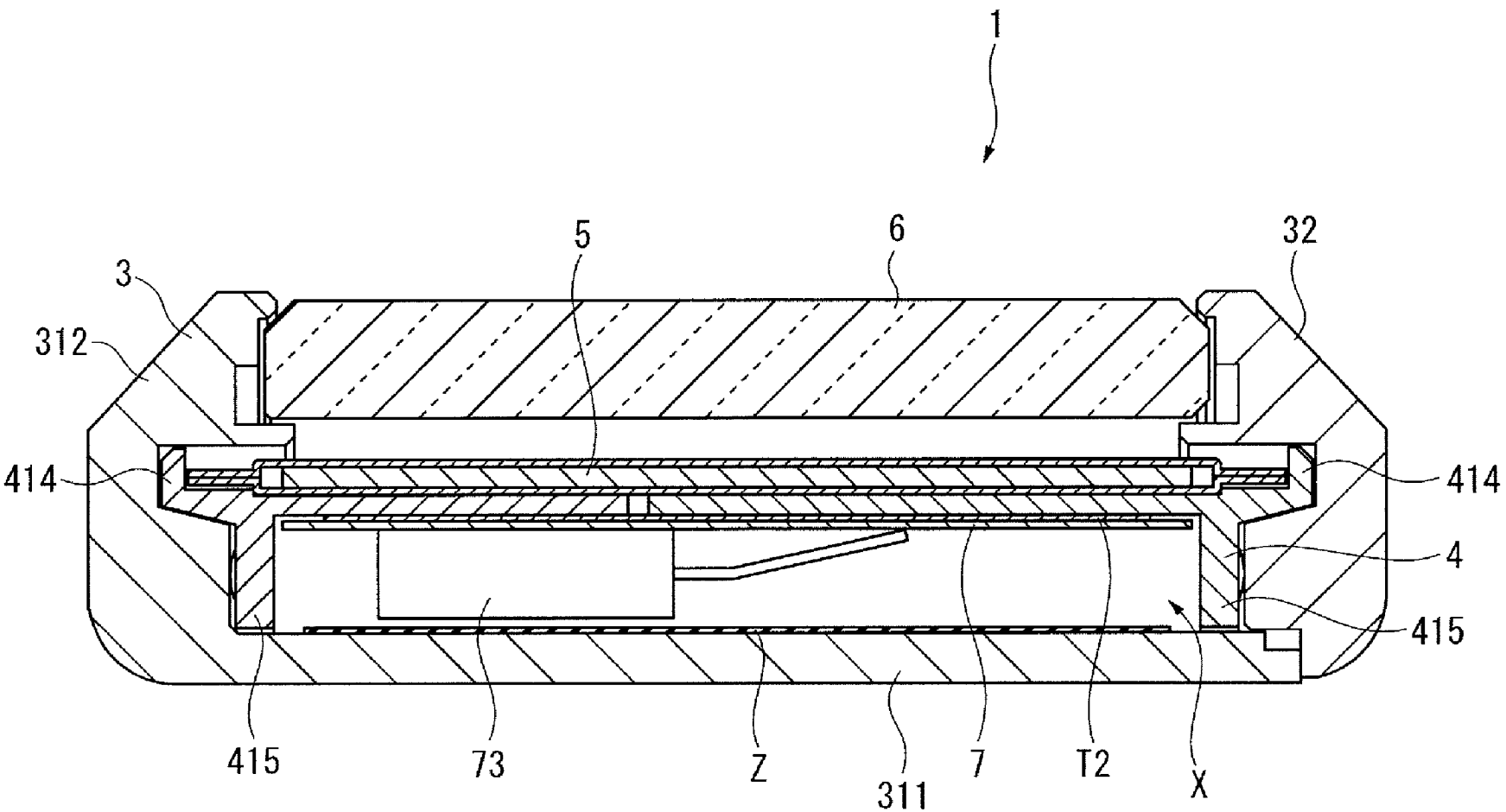
FIG. 8 is a section view through line D-D in FIG. 7.

FIG. 7 is a side section view of the timepiece 1 as seen from the flange 312 side, and FIG. 8 is a section view through line D-D in FIG. 7.

As shown in FIG. 8, the drive circuit unit 7 is affixed to the inside circumference surface of the spacer body 41 by double-sided tape T2. As also shown in FIG. 8, a dielectric seal Z for protecting the drive circuit unit 7, for example, is attached to the cylindrical part 311 of the frame 3.

Figure 9:
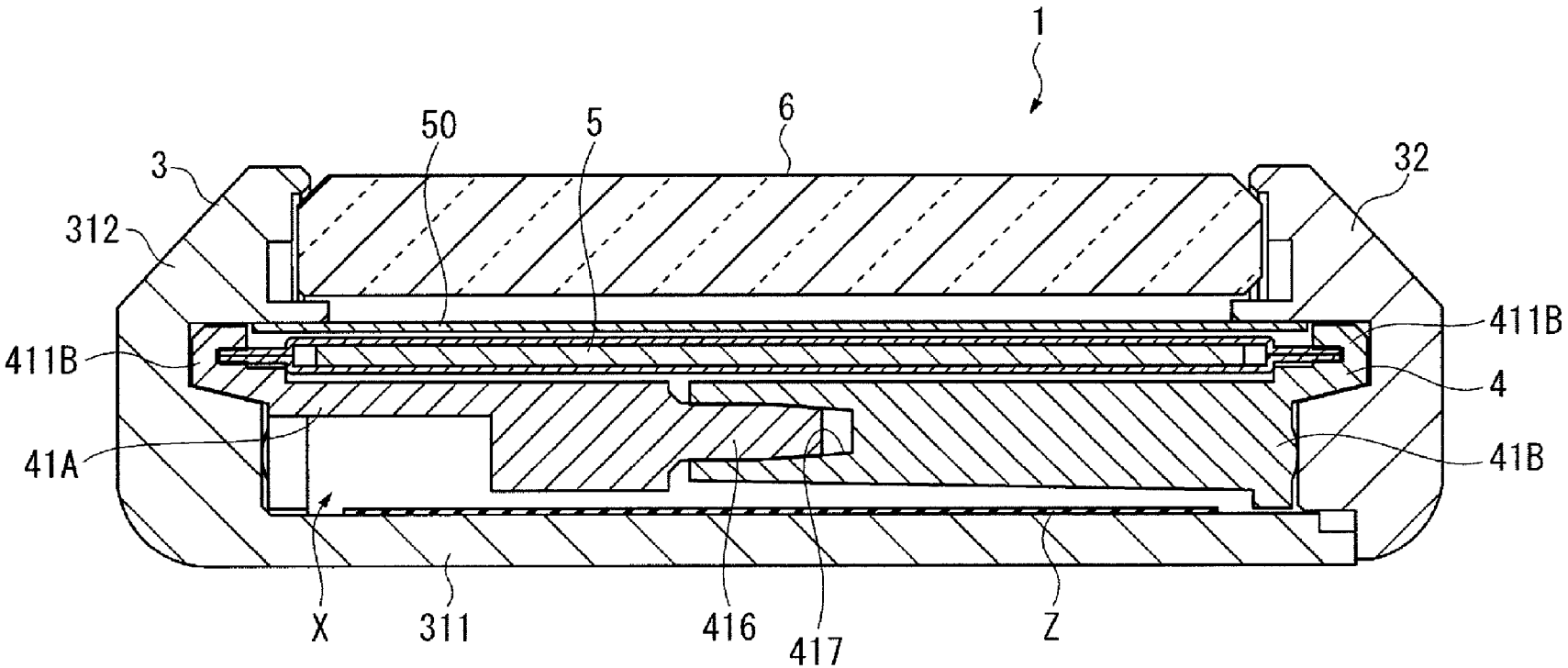
FIG. 9 is a section view through line A-A in FIG. 7.

FIG. 9 is a section view through line A-A in FIG. 7.

As shown in FIG. 2, the spacer body 41 includes a flange-side member 41A and a back-cover-side member 41B. A plurality of connection pins 416 are formed on the inside of the flange-side member 41A projecting towards the back-cover-side member 41B as shown in FIG. 9. A hole 417 is formed at a position corresponding to each of the connection pins 416 on the inside of the back-cover-side member 41B. The spacer body 41 is assembled by fitting these connection pins 416 into the matching holes 417 to connect the flange-side member 41A and the back-cover-side member 41B.

Figure 10:
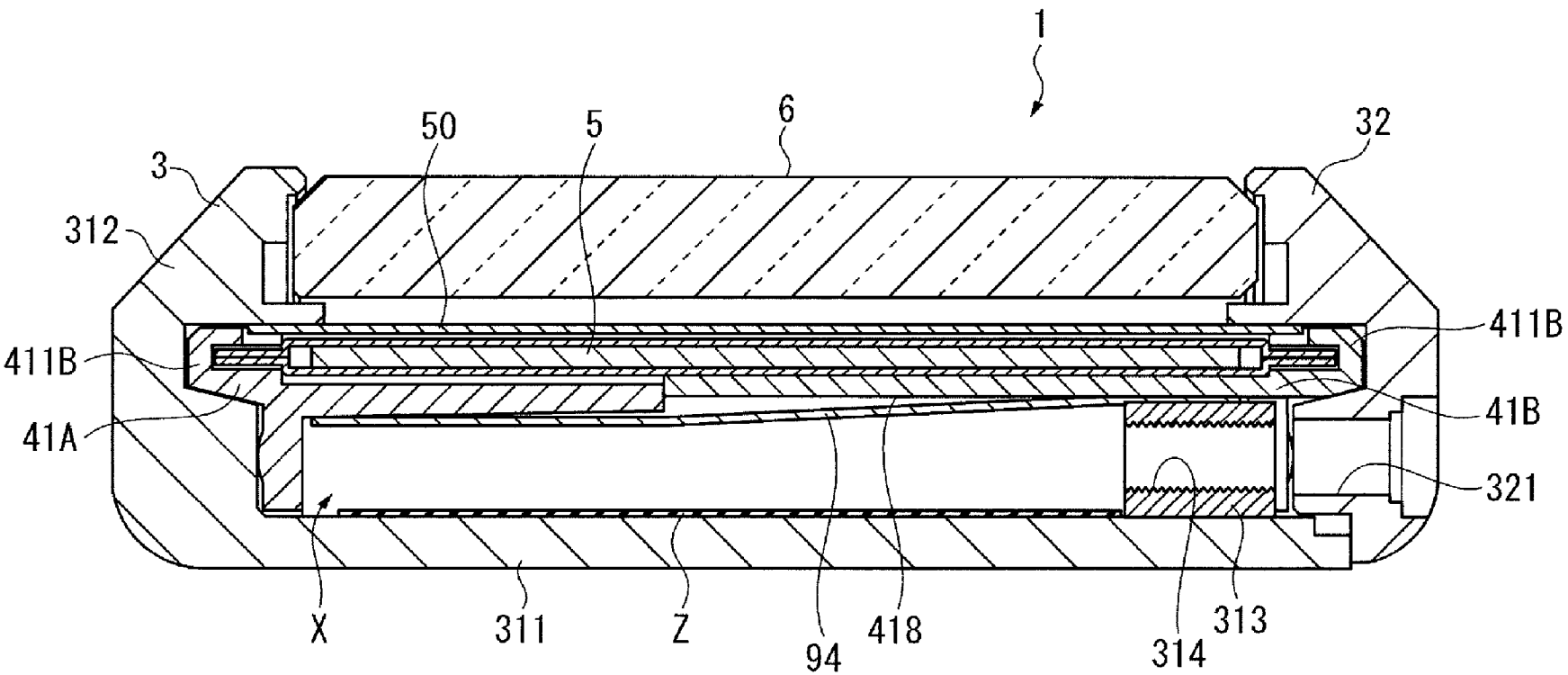
FIG. 10 is a section view through line B-B in FIG. 7.

FIG. 10 is a section view through line B-B in FIG. 7.

Channels 418 for holding the protrusions 313 are disposed to the inside circumference surface of the back-cover-side member 41B at positions corresponding to the protrusions 313 formed on the body 31 of the frame 3. The channels 418 are formed in line with the axis of the spacer 4.

After the spacer 4 is spread and fit onto the cylindrical part 311 of the frame 3, the spacer 4 is positioned by fitting the protrusions 313 into the channels 418 as shown in FIG. 10. The channels 418 also function to make spreading the spacer 4 open easier, and these channels 418 therefore make fitting the spacer 4 to the cylindrical part 311 easier.

6. Arrangement of the Button Input Unit

Figure 11:
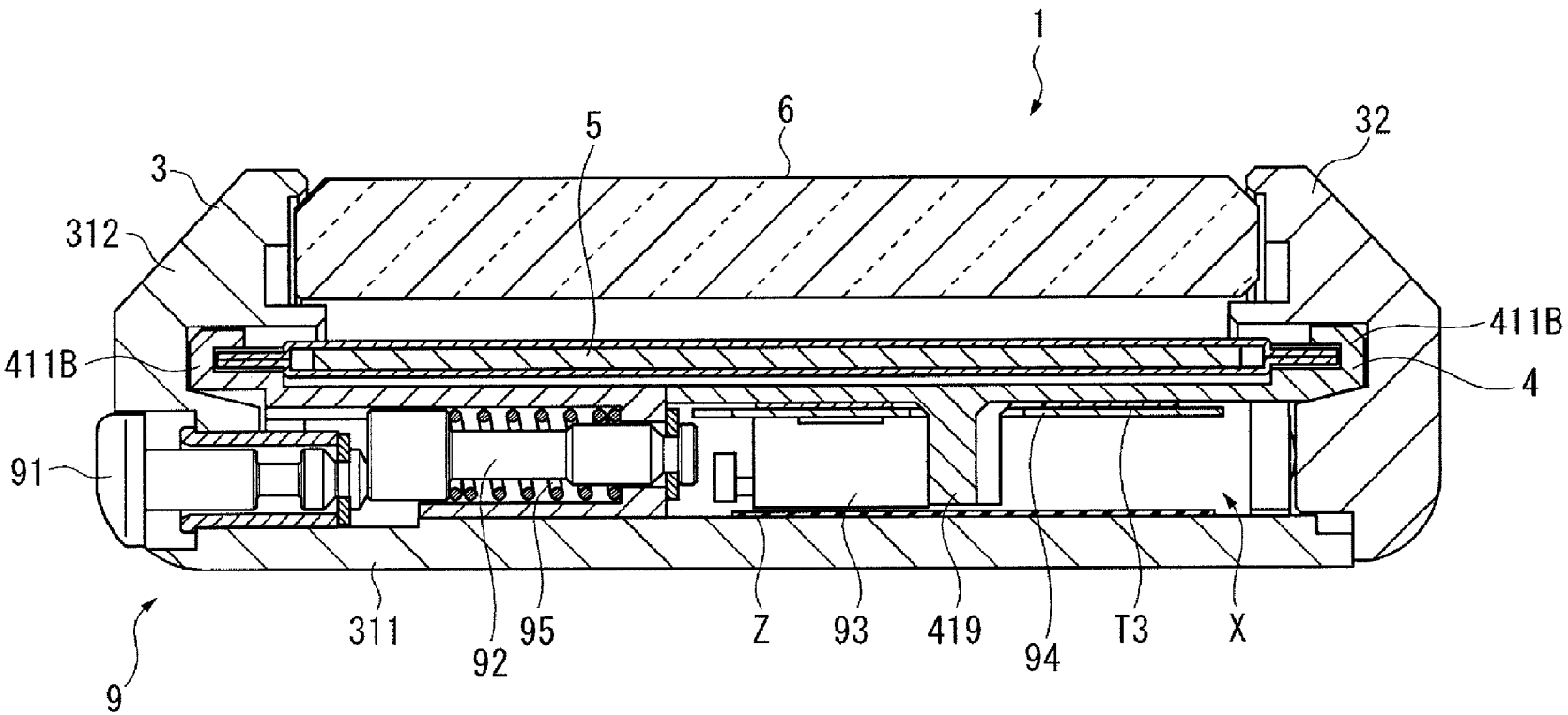
FIG. 11 is a section view through line C-C in FIG. 7.

FIG. 11 is a section view through line C-C in FIG. 7.

As shown in FIG. 7, three button input units 9 for controlling the timepiece 1 are disposed to the timepiece 1 according to this embodiment of the invention. As shown in FIG. 11, each button input unit 9 includes an operating button 91, an arm part 92, a tactile switch 93, a support wall 419, and a switch circuit 94.

The operating button 91 is disposed protruding to the outside from the side of the flange 312 and is supported so that it can be pushed into and out of the frame 3. The end part of the operating button 91 on the inside part of the frame 3 contacts the arm part 92. The arm part 92 is disposed slidably inside the frame 3 at a position matching the in-out sliding action of the operating button 91.

The arm part 92 has a coil spring 95, and this coil spring 95 urges the operating button 91 in the direction causing the operating button 91 to protrude from the frame 3. The operating button 91 is thus normally held in the protruding position.

The tactile switch 93, which is soldered to the switch circuit 94, is disposed at the opposite end of the arm part 92 as the operating button 91. The end part of the tactile switch 93 on the opposite side as the side facing the arm part 92 is supported by the support wall 419 rising from the spacer 4.

The switch circuit 94 is affixed by double-sided tape T3 to the inside circumference surface of the spacer 4.

The distal end of the arm part 92 does not touch the tactile switch 93 when the operating button 91 is in the protruding position. When the operating button 91 is depressed, the distal end of the arm part 92 moves toward the tactile switch 93 and presses the tactile switch 93. By rendering the support wall 419 to the spacer 4 in this embodiment of the invention, the tactile switch 93 can be supported by the support wall 419 so that the load on the soldered part of the tactile switch 93 can be reduced. The tactile switch 93 will therefore not separate from the switch circuit 94 and fall even if the tactile switch 93 is repeatedly pressed by the arm part 92.

As described above, the switch circuit 94 is connected to the drive circuit unit 7 by a wiring member C2. When the tactile switch 93 is pressed, an input signal from the switch circuit 94 is sent to the drive circuit unit 7 and the display panel 5 is controlled.

7. Arrangement of the Battery Storage Unit

The battery storage unit 8 holds a primary battery 10 so that the primary battery 10 can be replaced. As described above the battery storage unit 8 includes the battery holder 81 and the primary battery 10 (a button battery) that is held in the battery holder 81.

Figure 12:
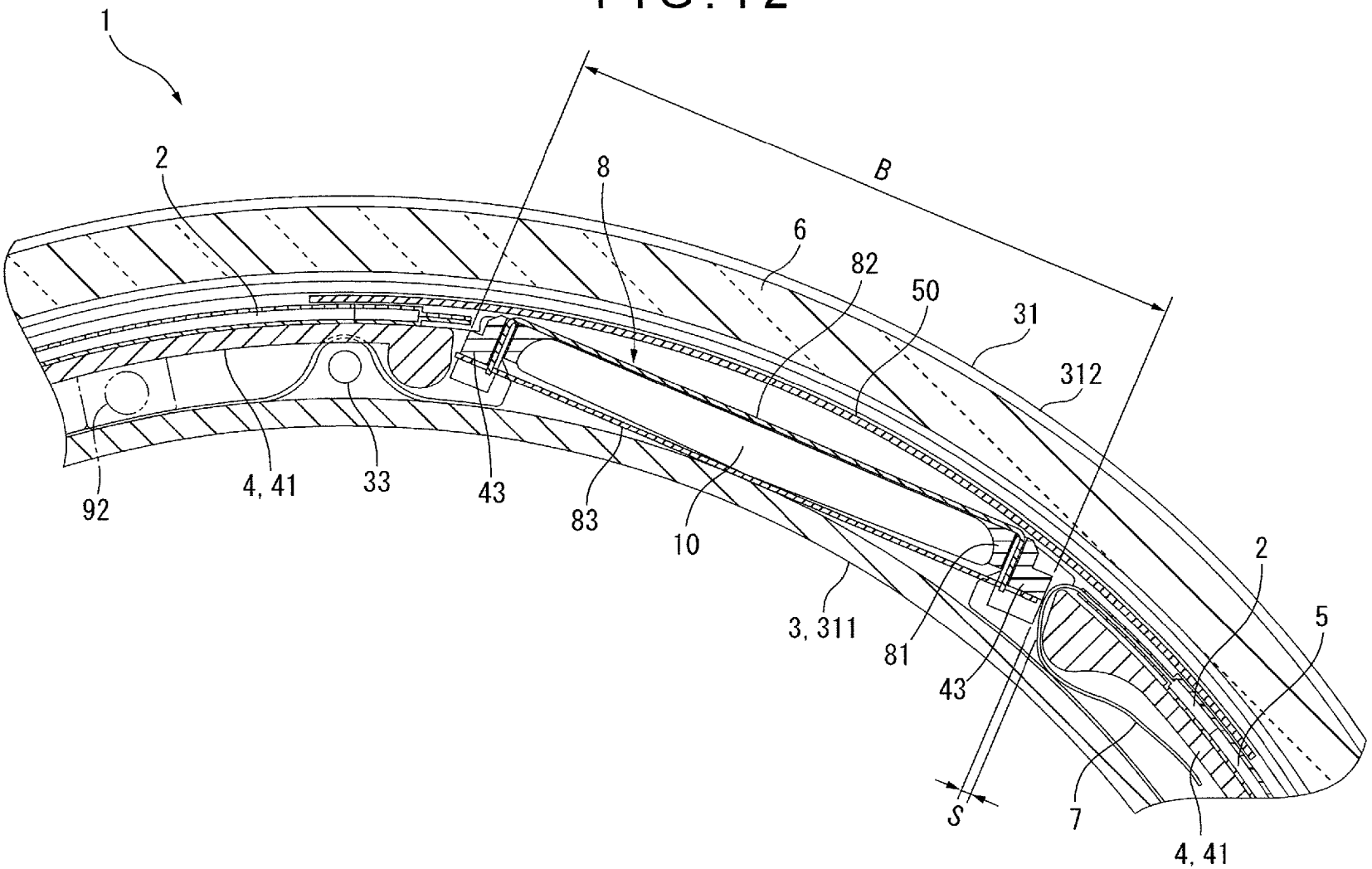
FIG. 12 is a section view showing a part of the timepiece in this embodiment of the invention.

FIG. 12 is a side section view of the battery storage unit 8 of the timepiece 1. As shown in FIG. 12 the primary battery 10, which is a battery for supplying power to the other parts of the timepiece 1, is located between the cylindrical part 311 of the body 31 and the glass crystal 6. The primary battery 10 is disposed in an area B between the ends of the display module 2. More specifically, the primary battery 10 is located between both end parts of the electrophoretic display panel 5 in the circumferential direction of the cylindrical part 311 of the body 31.

The battery storage unit 8 includes a positive-side presser member 82 and a negative-side presser member 83. The positive-side presser member 82 is metal and substantially C-shaped in section, covers the outside circumference side of the battery holder 81, and presses against the positive terminal of the primary battery 10. The negative-side presser member 83 is metal, is disposed between the primary battery 10 and the cylindrical part 311, and presses against the negative terminal of the primary battery 10.

The battery storage unit 8 thus comprised is housed in the holder retaining part 42 so that the battery storage unit 8 can slide parallel to the width of the spacer 4. The positive and negative presser members 82 and 83 are connected by conductors to the drive circuit unit 7 of the display module 2 to supply power to other parts.

Figure 13:
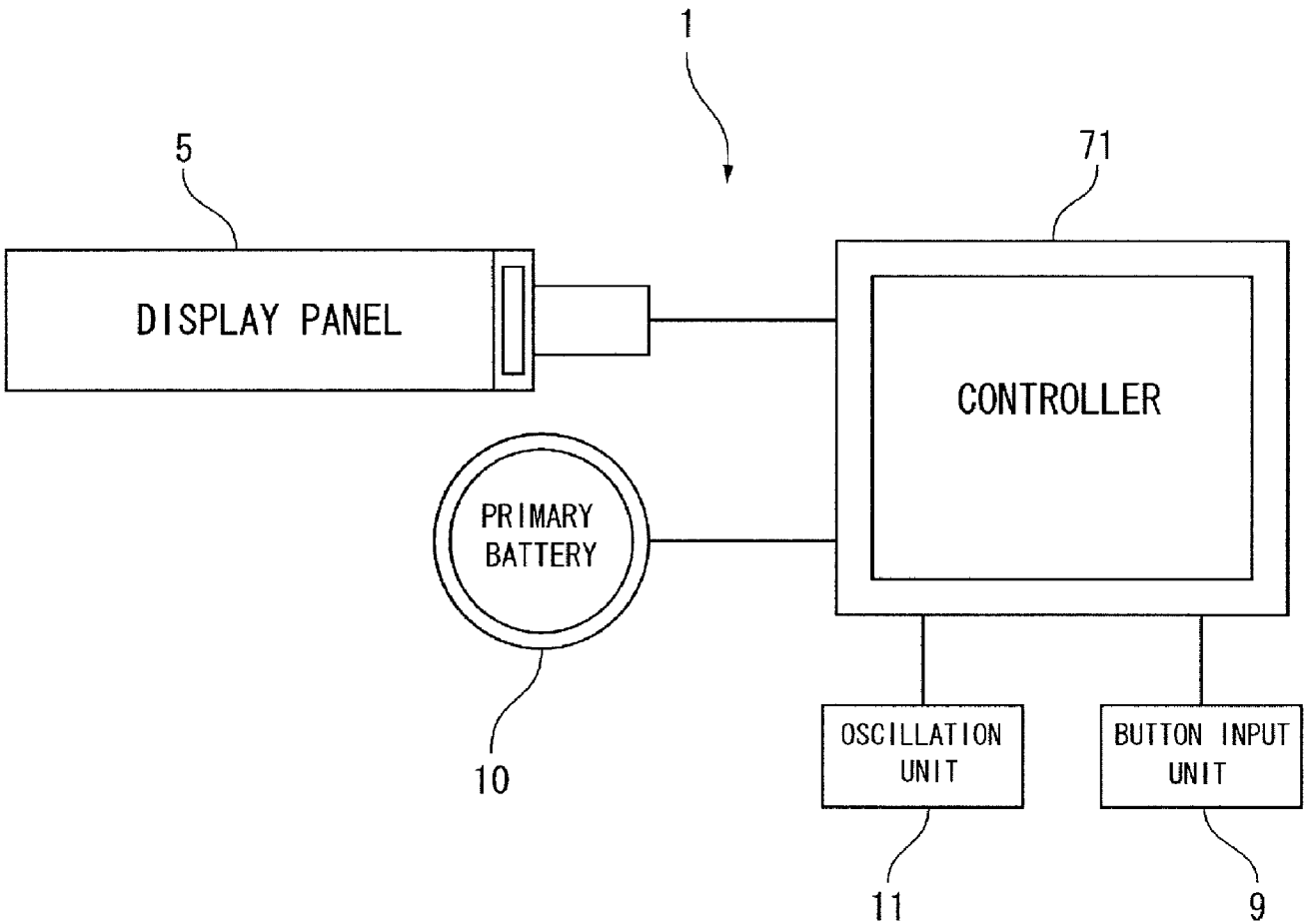
FIG. 13 shows the electrical arrangement of the timepiece in this embodiment of the invention.

FIG. 13 shows the electrical arrangement of the timepiece 1. The controller 71 that is mounted on the drive circuit unit 7 is electrically connected to the display panel 5, the primary battery 10, to the button input units 9 having the operating buttons, and to the oscillation unit 11. The oscillation unit 11 generates the oscillation pulses that are counted by the timekeeping unit not shown to keep the time.

8. Decorative Plate Arrangement

A decorative plate 50 (see FIG. 9 and FIG. 10) is disposed on the outside side of the battery storage unit 8 as shown in FIG. 7 as a cover member for covering the battery storage unit 8 and the gap S in the spacer 4. Decoration is imparted to the surface of the decorative plate 50. More specifically, the decorative plate 50 has a pattern not shown that is rendered by a complex and advanced processing method to impart a feeling of high quality. The decorative plate 50 also covers the battery storage unit 8 and the gap S in the spacer 4 in this embodiment of the invention to afford a nice appearance.

Figure 14:
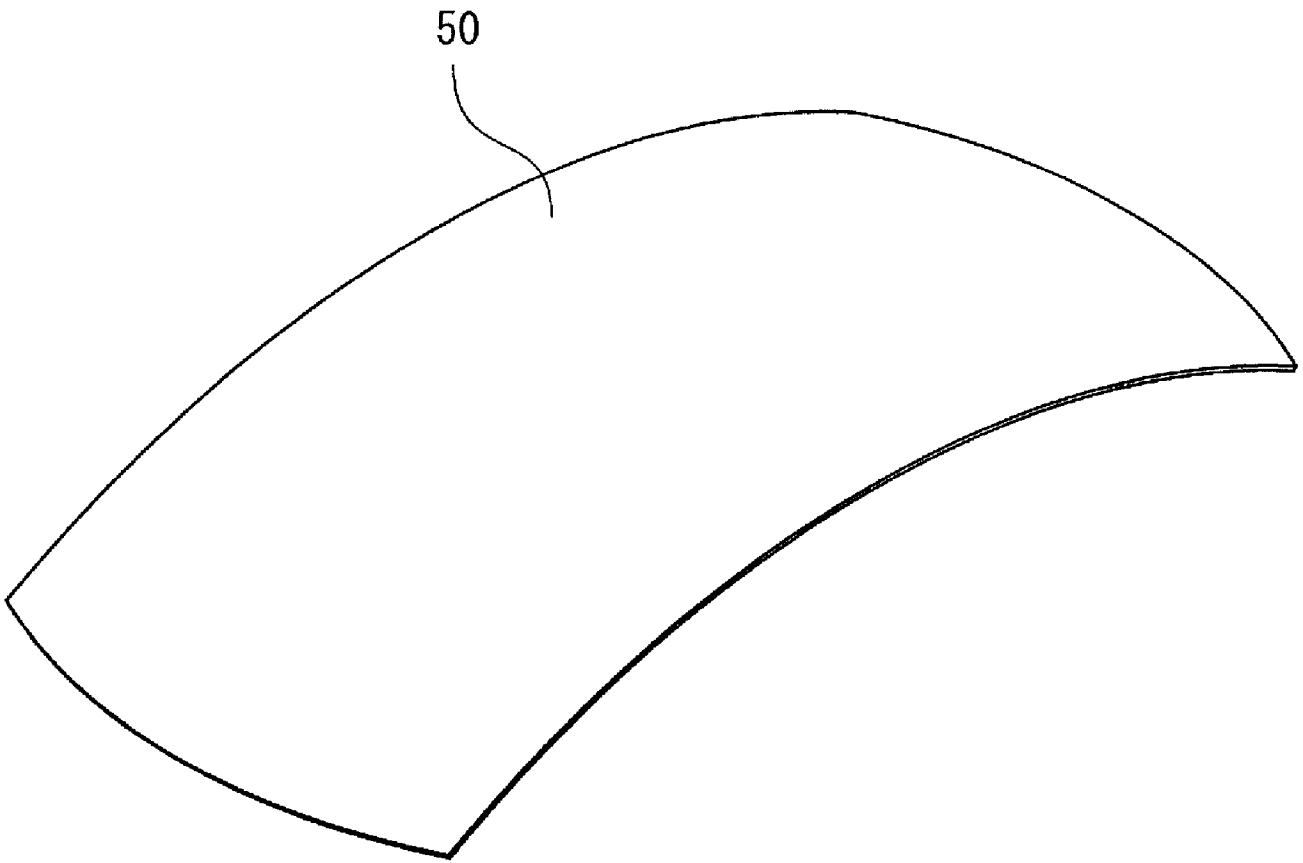
FIG. 14 is an oblique view of the cover member of the timepiece in this embodiment of the invention.
Figure 15:
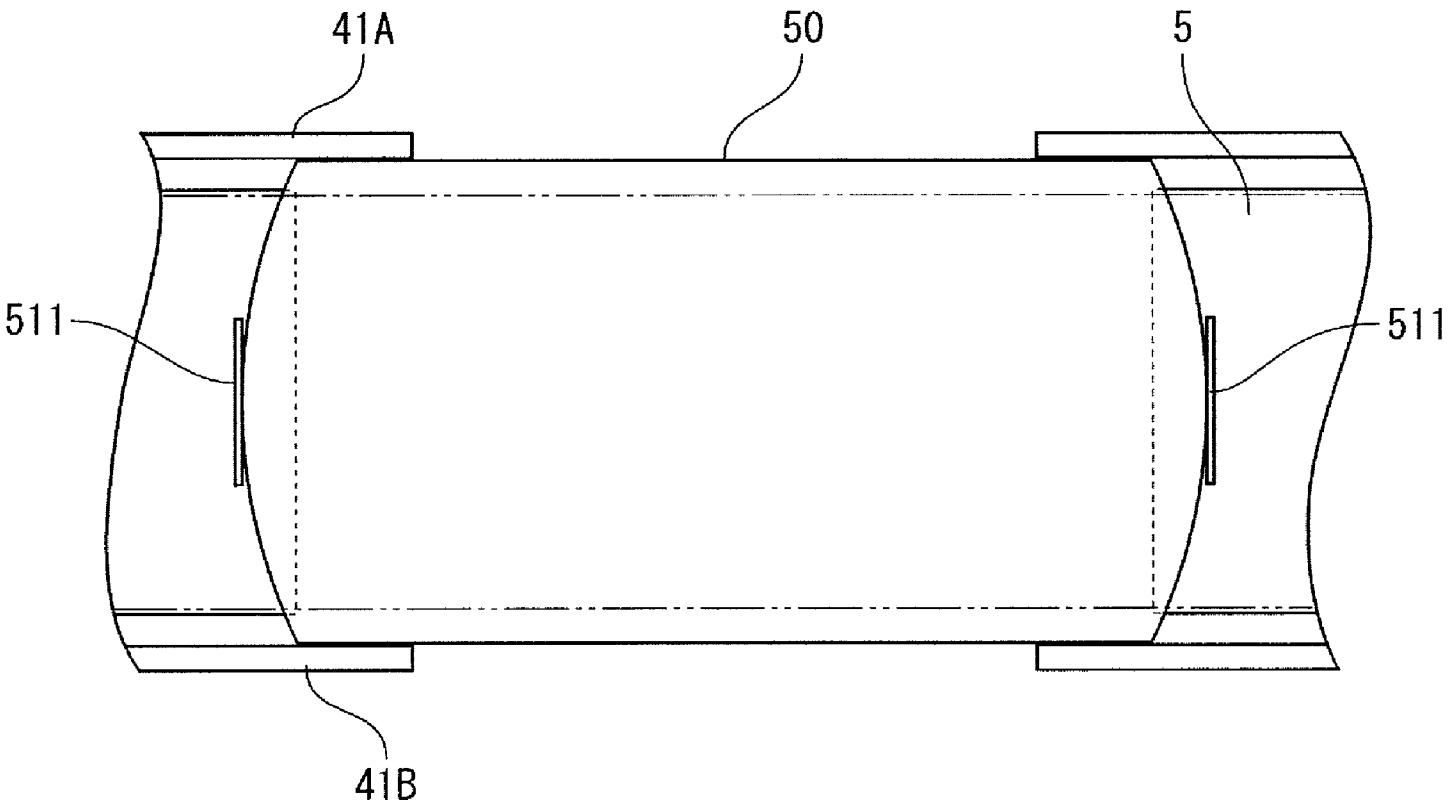
FIG. 15 is a partial plan view showing the position where the cover member is disposed in the timepiece according to this embodiment of the invention.

FIG. 14 is an oblique view of the decorative plate 50. FIG. 15 is a partial plan view showing the position where the decorative plate 50 is disposed. The decorative plate 50 is formed with a curve conforming to the outside shape of the body 31 of the frame 3. Both ends of the decorative plate 50 in the circumferential direction of the frame 3 are curved when seen in plan view as shown in FIG. 15.

Decorative plate position indication units 511 ("position indication units" below) are formed as cover member position indication parts at both circumferential ends of the display panel 5 for positioning the decorative plate 50. The position indication units 511 are provided to illuminate and show where the decorative plate 50 is positioned. The position indication units 511 are formed in a line in one place at each end of the display panel 5. The distance between the position indication units 511 along the outside surface of the frame 3 is the same as the length of the decorative plate 50 along the outside surface of the frame 3. The ends of the decorative plate 50 can thus be positioned according to the position indication units 511 disposed to the display panel 5.

9. Timepiece Assembly

Assembling the timepiece 1 is described next.

The display module 2 is first attached to the spacer 4. More specifically, the distal end of the display panel 5 is passed through the channels 412 of the second holding part 411B of the spacer 4, then inserted to the channels 412 of the first holding part 411A until the distal end of the display panel 5 contacts the panel abutment 413 to position the display panel 5 to the spacer 4. The middle part of the display panel 5 is then pressed to the double-sided tape T1 that was previously fixed to the middle part of the spacer body 41 to bond the middle of the display panel 5 to the spacer body 41.

The wiring member C1 and the excess length part of the display panel 5, if the length of the display panel 5 is somewhat longer than the length along the outside circumference of the spacer body 41 due to manufacturing variations, are then passed through the gap S in the spacer 4, then folded over at this gap S, and the drive circuit unit 7 is affixed to the inside circumference surface of the spacer 4 by the double-sided tape T2. The switch circuit 94 is then affixed to the inside circumference surface of the spacer 4 by the double-sided tape T3. This attaches the display module 2 to the spacer 4.

The battery storage unit 8 holding the primary battery 10 is then installed to the holder retaining part 42 of the spacer 4.

After assembling the display module 2 and the battery storage unit 8 to the spacer 4, the spacer 4 is spread open and fit onto the cylindrical part 311 of the frame 3, the protrusions 313 of the cylindrical part 311 are fit into the channels 418 disposed to the inside circumference of the spacer 4, and the spacer 4 is thus positioned to the frame 3.

The decorative plate 50 for hiding the battery storage unit 8 and the gap S in the spacer 4 is then positioned to the outside of the battery storage unit 8, and the glass crystal 6 is fit outside the display module 2 and the decorative plate 50. The back cover 32 is then fastened with screws to the body 31 and assembly is completed.

10. Positioning the Decorative Plate

Positioning the decorative plate 50 during assembly is described next.

The position indication units 511 of the display panel 5 shown in FIG. 15 are first turned on to illuminate. The display panel 5 is then positioned so that the ends of the decorative plate 50 are aligned with the position indication units 511. The position indication units 511 are then turned off. The position indication units 511 can be turned on only for positioning the decorative plate 50 and can be kept off during normal use.

This enables easily and accurately positioning the decorative plate 50.

11. Replacing the Primary Battery

Replacing the primary battery 10 is described next.

The first step is to unscrew the screws 33 shown in FIG. 1 and remove the back cover 32 from the body 31. The battery holder 81 shown in FIG. 6 and FIG. 12 is then slid along axis A to remove the battery holder 81 from the spacer 4. The primary battery 10 held in the battery holder 81 is then replaced. The battery holder 81 is then installed to the spacer 4 and the back cover 32 is fastened with screws to the body 31 by reversing the procedure described above.

The primary battery 10 is thus replaced.

12. Effect of this Embodiment of the Invention

The effect of this embodiment of the invention is described next.

(1) The display panel 5 can be disposed in a stable, annular condition because the display panel 5 is first disposed to the outside of a basically cylindrical spacer body 41 with substantially the entire bottom surface of the display panel 5 in contact with the spacer body 41. Furthermore, because substantially the entire bottom surface of the display panel 5 is touching the spacer body 41, the display panel 5 can be securely positioned by affixing only portions of both side edges and the middle portion, and the fixed area of the display panel 5 can thus be reduced. Distortion of the display panel 5 can thereby be reduced and image quality degradation can be prevented.

More specifically, the parts between the fixed side edge portions and middle portion are free because only the side edge portions and the middle portion of the display panel 5 are fixed in position. If a compressive force is then applied between the side edge portions and the middle portion, distortion of the display panel 5 caused by the area between the side edge portions and the middle portion flexing can be prevented. If only the side edge portions of the display panel 5 are secured, the middle portion of the display panel 5 in particular easily separates from the spacer body 41 due to the restoring force of the display panel 5. By securing the middle part of the display panel 5 in addition to the side edge portions, however, this embodiment of the invention can attach the display panel 5 tightly to the spacer body 41, and can thereby render the display panel 5 in a more stable condition.

(2) When the display panel 5 is secured by passing the edge portions in the middle part of the display panel 5 through channels in a holding part, the holding part applies pressure to the middle part of the display panel 5. By attaching the middle part of the display panel 5 with double-sided tape T1 instead of such a holding part, however, the invention reduces the force pressing on the display panel 5 and can thereby more effectively suppress distortion. The display panel 5 can also be easily installed because there is no need to pass the edge portions of the display panel 5 through channels.

(3) Movement of the display panel 5 can be effectively reduced and the display panel 5 can be disposed more securely as a result of rendering guide parts 414 for guiding the display panel 5 opposite the holding parts 411A, 411B on the outside surface of the spacer body 41.

(4) Manufacturing variations can result in the length of the display panel 5 being slightly greater than the length around the outside of the spacer body 41. By forming a gap S large enough to enable inserting the display panel 5 in the spacer 4, however, part of the display panel 5 can be disposed in this gap S portion and below the spacer body 41, and the display panel 5 can therefore be rendered more tightly to the spacer body 41.

(5) Because a panel abutment 413 rises across the width of the spacer body 41 at one circumferential end part of the spacer body 41, the display panel 5 can be easily positioned by sliding the distal end of the display panel 5 so that it contacts the panel abutment 413.

(6) If the spacer 4 fits too tightly to the cylindrical part 311 due to variations in manufacture, the spacer 4 can still be easily fit to the cylindrical part 311 because the spacer 4 is elastically deformable and is formed with a break at one part in the circumference so that the gap at this break can be expanded. Cracking the spacer 4 by forcibly fitting the spacer 4 to the cylindrical part 311 can therefore be prevented. Distortion of the spacer 4, and therefore the display panel 5, resulting from fitting the spacer 4 to the cylindrical part 311 with excessive force can also be prevented.

Furthermore, because the spacer 4 is elastically deformable and is formed with a break at one part circumferentially, the spacer 4 can also absorb the force of impact and vibrations caused by dropping the timepiece 1, for example, and the effect of such impact and vibration on the display panel 5 can be reduced.

(7) Furthermore, because channels 418 for accepting the protrusions 313 are formed on the inside surface of the spacer body 41 at positions corresponding to the protrusions 313 of the cylindrical part 311, the spacer 4 and therefore the display panel 5 can be easily positioned to the frame 3 by fitting the protrusions 313 into the channels 418.

The spacer 4 can also be easily expanded and the spacer 4 can be more easily fit onto the cylindrical part 311 because channels 418 are disposed to the inside surface of the spacer 4.

(8) By rendering the cylindrical part 311 and the flange 312 in unison, the protrusions 313 function both to position the spacer 4 and to secure the back cover 32, thereby simplifying the arrangement.

(9) By disposing the primary battery 10 between the two end parts of the electrophoretic display panel 5 that is wrapped around the outside surface of the body 31, the thickness of the part where the display panel 5 and the primary battery 10 are disposed can be reduced and a thinner design can be achieved compared with an arrangement in which the display panel 5 and the primary battery 10 overlap each other.

(10) By covering the end parts of the display panel 5 including the primary battery 10 with the decorative plate 50, the primary battery 10 and the battery storage unit 8 can be hidden so that they cannot be seen through the glass crystal 6, and the appearance can therefore be improved.

(11) Decorativeness can be improved by rendering decoration including text, symbols, and patterns, for example, on the surface of the decorative plate 50. By rendering a pattern using a complicated, advanced processing technique on the surface of the decorative plate 50, for example, a luxurious appearance can be imparted.

(12) A uniform appearance can be achieved over the entire outside surface of the body 31 as a result of the decorative plate 50 and the display panel 5 curving around the outside of the body 31 and the decorative plate 50 covering the primary battery 10.

(13) The decorative plate 50 can be easily positioned during assembly because the decorative plate position indication units 511 disposed to the display panel 5 can be illuminated. Furthermore, because the position indication units 511 can be turned off after the decorative plate 50 is positioned, a nice appearance can be achieved without exposing the position indication units 511.

(14) The display panel 5 and the decorative plate 50 can be reliably secured and protected from scratches and soiling because the display panel 5 and the decorative plate 50 are covered by the glass crystal 6. Furthermore, because the spacer 4, the display panel 5, and the glass crystal 6 are held between the flange 312 of the body 31 and the back cover 32, the spacer 4, the display panel 5, and the glass crystal 6 can be reliably fixed to the frame 3 and can be easily assembled.

(15) The battery can be easily replaced by simply removing the back cover 32 from the body 31 and sliding the battery holder 81 out from the spacer 4 to access and replace the primary battery 10. Dust, lint, and other foreign matter is also prevented from getting inside the frame 3 because disassembling the glass crystal 6 or spacer 4 to replace the battery is not necessary.

Embodiment 2

Figure 16:
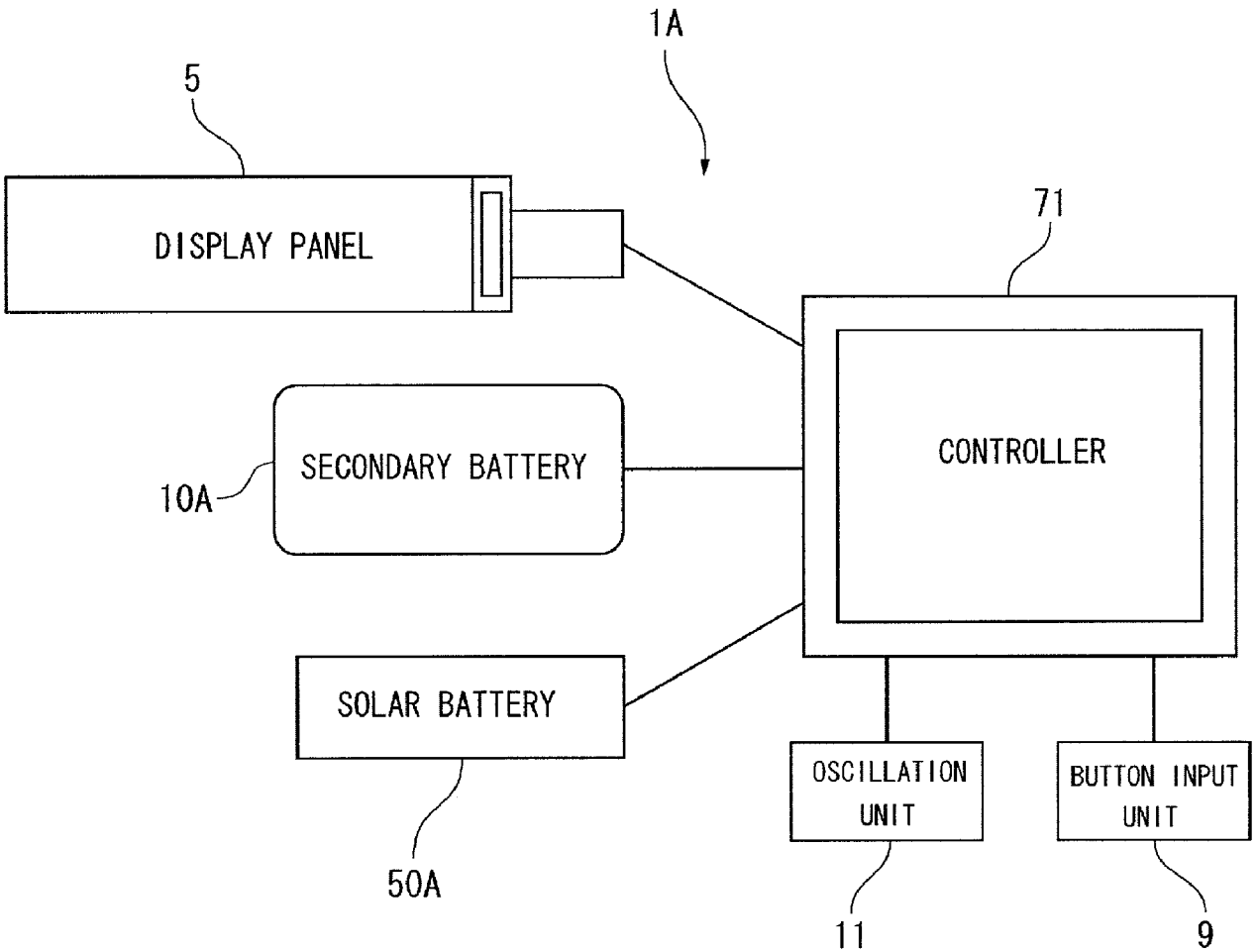
FIG. 16 shows the electrical arrangement of the timepiece in a second embodiment of the invention.
Figure 17:
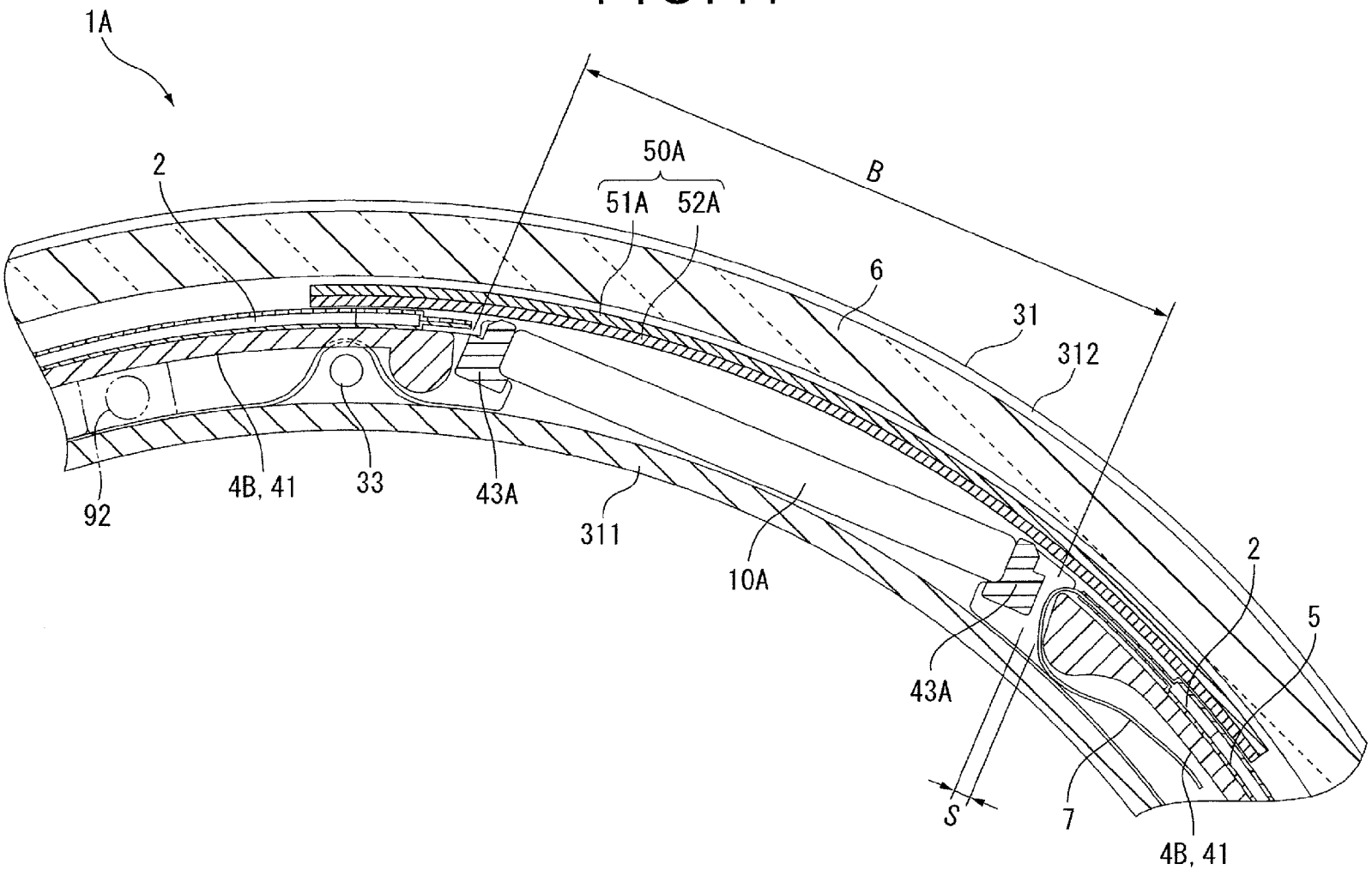
FIG. 17 is a section view showing a part of the timepiece in this embodiment of the invention.

A second embodiment of the invention is described next. FIG. 16 shows the electrical arrangement of a timepiece 1A according to this embodiment of the invention. FIG. 17 is a side section view of this timepiece 1A.

This embodiment differs from the first embodiment in that it uses a secondary battery 10A as the battery, locates the secondary battery 10A in the position of the primary battery 10 in the first embodiment, and uses a photoelectric conversion means (solar battery) 50A as the cover member. The basic arrangement of this embodiment is otherwise identical to the first embodiment.

More specifically, the timepiece 1A has a solar battery 50A that can convert light energy to electrical energy, and has a secondary battery 10A for storing the electrical energy produced by the solar battery 50A. As shown in FIG. 16 the solar battery 50A and the secondary battery 10A are electrically connected to the controller 71.

As shown in FIG. 17, the spacer 4B includes the spacer body 41 and a secondary battery holding member 43A, and the secondary battery 10A is held in this secondary battery holding member 43A. The secondary battery 10A is located between the ends of the display panel 5 in the same way as the primary battery 10 in the first embodiment.

The solar battery 50A is a two layer structure including the main solar cell 51A and a support member 52A, and is disposed along the outside of the body 31. The main solar cell 51A is a flexible thin film. Similarly to the display panel 5, the support member 52A is shaped to conform to the outside surface of the cylindrical part 311 of the body 31. The main solar cell 51A is affixed to the outside surface of the support member 52A. Similarly to the decorative plate 50 in the first embodiment, the solar battery 50A is disposed between the glass crystal 6 and the cylindrical part 311 of the body 31, and covers the secondary battery 10A and both ends of the display panel 5.

The solar battery 50A converts light energy to electrical energy in this configuration. The resulting electrical energy is stored in the secondary battery 10A and supplied as needed from the secondary battery 10A to other parts.

13. Effect of this Embodiment of the Invention

This embodiment of the invention affords the following effects in addition to the effects (1) to (14) of the first embodiment described above.

By providing a solar battery 50A and a secondary battery 10A, electrical energy can be constantly supplied even if the electrical energy stored in the secondary battery 10A is supplied to other parts because the electrical energy newly produced by the solar battery 50A can be stored in the secondary battery 10A. Compared with an arrangement that uses a primary battery, this embodiment eliminates the need to regularly replace the battery and thereby reduces the burden on the user. There are also no depleted waste batteries to throw away, and the timepiece 1A is therefore environmentally friendly.

Furthermore, because the main solar cell 51A is a flexible thin film and the main solar cell 51A can be disposed to the outside surface of the support member 52A, the thickness of the solar battery 50A can kept thin. The thickness of the timepiece 1A where the solar battery 50A is located can therefore also be thin, and an excellent appearance can be achieved.

14. Variations of the Invention

The invention is not limited to the foregoing embodiments and variations and improvements that can achieve the same purpose as the invention are included within the scope of this invention.

Figure 18:
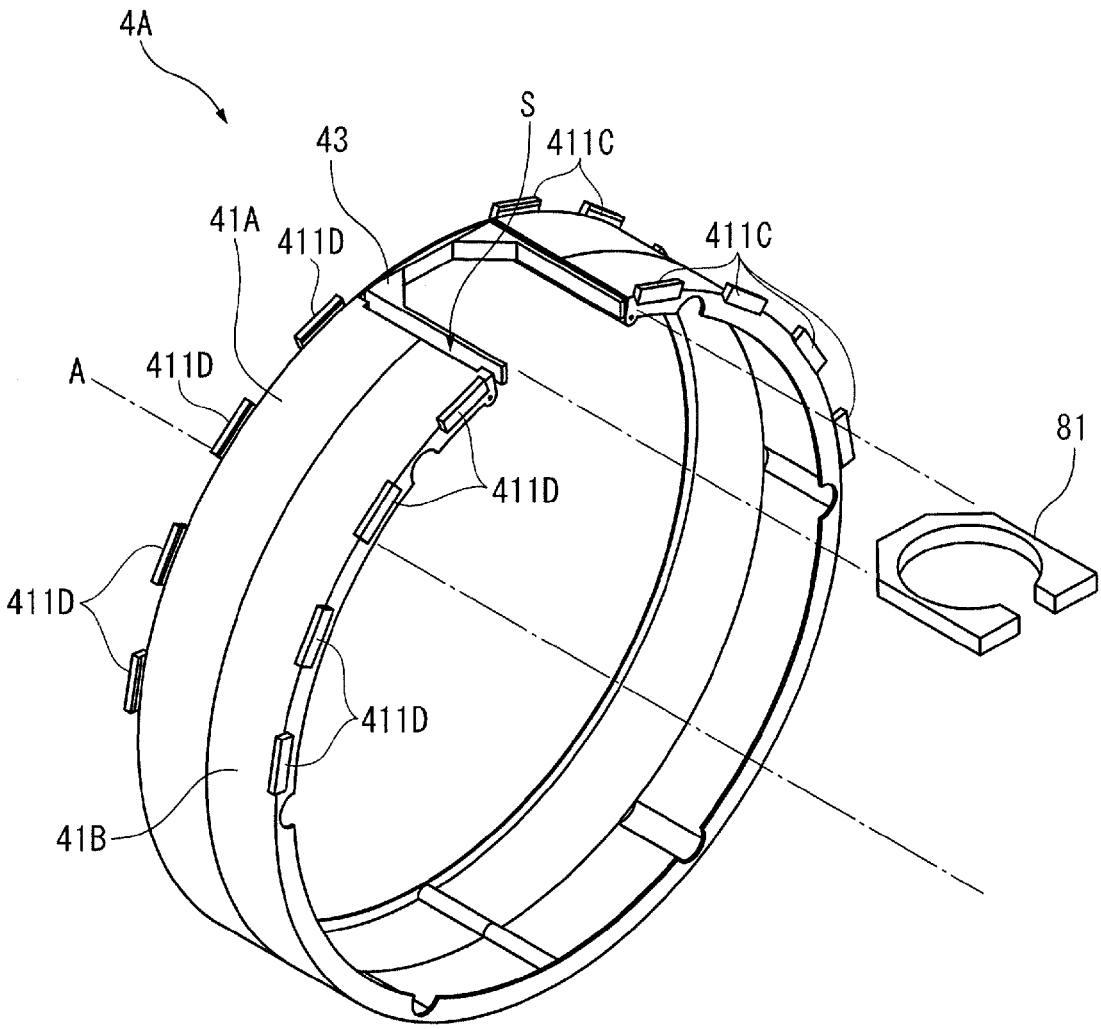
FIG. 18 is an oblique view of the spacer in a timepiece according to a variation of the invention.

For example, holding parts 411A, 411B are disposed to the spacer in the foregoing embodiments, but a spacer 4A having plurality of holding parts 411C, 411D can be used as a variation of this spacer. FIG. 18 is an oblique view of a spacer 4A according to such a variation of the invention. As shown in FIG. 18 the spacer 4A is for holding the display module 2 in a curved tubular shape, and includes a flange-side member 41A, a back-cover-side member 41B, and a holder retaining part 43 for storing the battery holder 81. The flange-side member 41A and the back-cover-side member 41B are non-continuous rings having a break in one part of the ring. A plurality of holding parts 411C, 411D for retaining the display module 2 are formed along an edge of the side members 41A and 41B.

As shown in FIG. 18, the holder retaining part 43 is substantially C-shaped and supports a similarly C-shaped flat battery holder 81 so that the battery holder 81 can slide parallel to axis A. The sides of the flange-side member 41A and the back-cover-side member 41B perpendicular to axis A are bonded together so that the non-continuous parts align, and the holder retaining part 43 is installed to this break in the side members.

The battery holder 81 described below for holding a primary battery 10 is supported in the holder retaining part 43 so that the battery holder 81 can slide along axis A. When the battery holder 81 is disposed in the space enclosed by the spacer 4A and the frame 3 and glass crystal 6, the primary battery 10 can be replaced by removing the back cover 32 and sliding the battery holder 81 towards the back cover 32.

Figure 19:
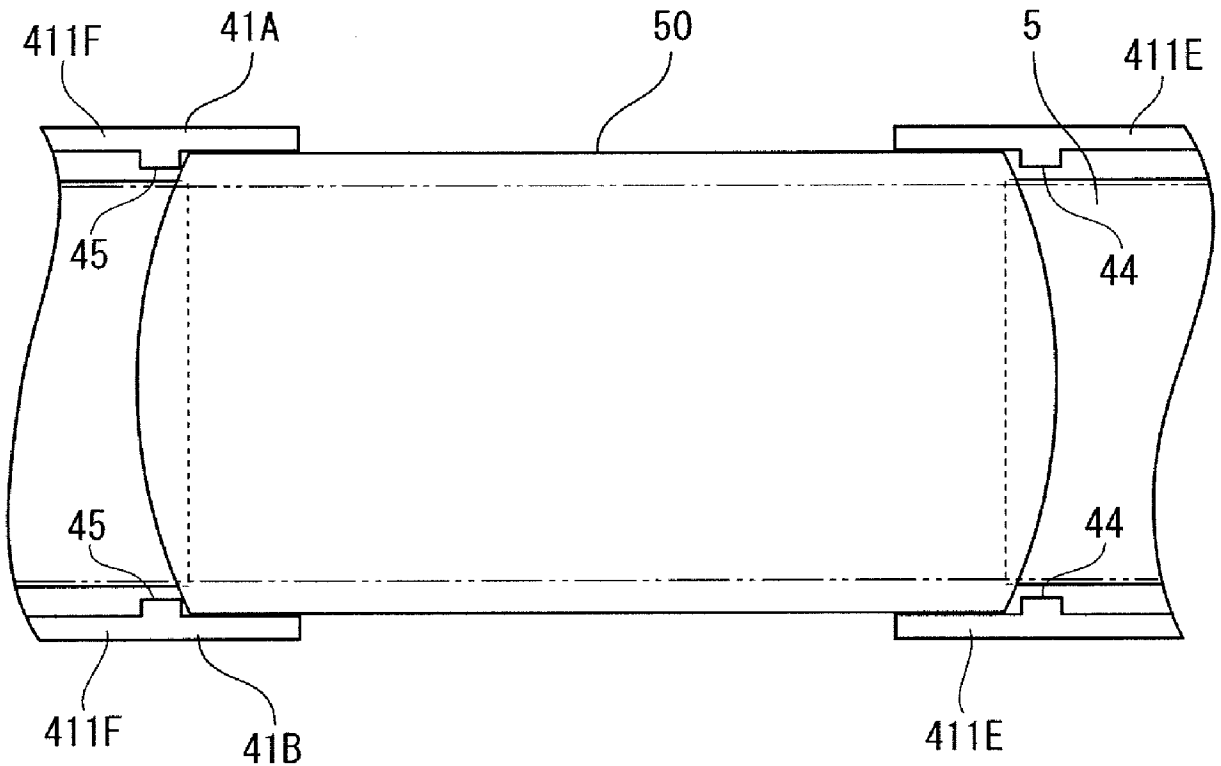
FIG. 19 is a partial plan view showing the position where the cover member is disposed in the timepiece according to a variation of the invention.

Decorative plate position indication units 511 are disposed to the display panel 5 in the embodiment described above, but another aspect of the invention renders tabs 44 and 45 projecting to the inside of holding parts 411E and 411F as the arrangement for positioning the decorative plate 50. FIG. 19 is a plan view showing the position where the decorative plate 50 is disposed in a timepiece according to this aspect of the invention.

As shown in FIG. 19 the decorative plate 50 can be positioned in the circumferential direction by causing the circumferential end parts of the decorative plate 50 to contact the tabs 44 and 45. This enables positioning the decorative plate 50 easily in a short time during the assembly process, and makes assembly more efficient.

The spacer 4 is formed in the above embodiments with a break in the circumference so that the spacer 4 can be elastically deformed, but the spacer does not require such a break.

If a break is not provided in the spacer, a slit can be rendered in the spacer so that the excess part of the display panel 5 can be passed through the slit and disposed in the space between the spacer and the cylindrical part 311.

In addition, when a break is not provided in the spacer, grooves that can receive the protrusions 313 and run from edge to edge on the inside circumference surface of the spacer are formed at positions corresponding to each of the protrusions 313 on the cylindrical part 311. After aligning the grooves with the protrusions 313, the spacer is then slid towards the flange 312 to fit the spacer onto the cylindrical part 311.

The protrusions 313 are formed on the edge part of the cylindrical part 311 and function both for positioning and for fastening the back cover 32, but the protrusions can be used only for positioning. If the protrusions are used only for positioning, they can be disposed at suitable positions on the outside of the cylinder part. The protrusions can also be omitted.

The frame 3 includes two parts, a substantially L-shaped body 31 and back cover 32, in the foregoing embodiments, but the cylinder part rendering the body and the flange part can be manufactured separately such that the frame is composed of three parts, the cylinder part, the flange part, and the back cover.

The battery storage unit 8 is disposed to an edge part of the spacer body 41 in the above embodiments, but the battery storage unit can be located between the spacer and the cylinder part.

The cylinder part (cylindrical part 311) is circular in the above embodiments, but can be a polygonal tube instead.

The display panel 5 is secured at both ends by holding parts 411A, 411B having a pair of channels 412 and is secured in the middle by double-sided tape T1, but the middle part can alternatively be secured by a holding part having a pair of channels. The display panel 5 is also not limited to being secured at both ends and the middle, and can be secured at multiple other locations.

The display panel 5 can also be adhesively attached to the spacer 4 with adhesive.

A glass crystal 6 is used as the transparent member in the foregoing embodiments of the invention, but any member, such as a transparent plastic cover, that enables seeing the display panel can be used. A colored member can be used if it is also transparent.

The first embodiment of the invention is described using by way of example a timepiece 1 having a decorative plate 50 and a frame 3 of a prescribed diameter, but can also be rendered as timepieces of different sizes having, for example, a frame of a different diameter, a decorative plate having a circumferential length adjusted for the diameter of the frame, and the same display panel 5 as in the first embodiment. To assemble this timepiece the display panel 5 is disposed to the outside of the frame in the same way as in the first embodiment, and the decorative plate is then positioned to cover both end parts of the display panel 5. This arrangement enables using a common display panel 5 with frames 3 of different diameters by simply changing the length of the decorative plate 50 in the circumferential direction. Common parts can thus be used for different products, and the cost can therefore be reduced.

The spacer 4 includes a flange-side member 41A and a back-cover-side member 41B in the foregoing embodiments of the invention, but these can be formed as a single part.

The display device can further alternatively be rendered with the battery overlapping the display panel and the solar cell used as the cover member covering the ends of the display panel.

The decorative plate 50 used as a cover member in the first embodiment of the invention extends above both end parts of the electrophoretic display panel 5 and is formed to cover both end parts, but in the present invention must only be shaped to cover at least the primary battery 10. However, by forming the display panel 5 to cover both end parts of the display panel 5, the wiring member C1 at the end of the display panel 5 can also be reliably covered and the design can be improved.

The foregoing embodiments of the invention are described using an electrophoretic display panel by way of example as the display panel, but the display panel of the invention can, for example, be an organic EL panel instead. More specifically, any band-shaped display panel that is also flexible can be used.

The second embodiment of the invention is described using a secondary battery 10A by way of example as the battery and the secondary battery 10A can be charged by providing a common charging terminal in the frame or by supplying power wirelessly using an electromagnetic induction method, for example.

The secondary battery 10A used in the second embodiment can also be supported and stored so that the battery can slide when the back cover is removed in the same way as the primary battery 10 in the first embodiment. This arrangement makes replacing the secondary battery 10A simple and helps prevent foreign matter from entering the frame 3 when the battery is replaced.

The invention is described above using a timepiece by way of example, but the invention can rendered in a cell phone, a digital camera, or a personal digital assistant (PDA) device, for example. More specifically, the display device of the invention is not limited to displaying time, and can function to display various types of information. The display device is also not limited to being worn as a bracelet, and can be placed or worn as desired, including suspended on a chain from a wall, for example.

The best mode and method of achieving the invention are described above, but the invention is not limited to the foregoing embodiments. More specifically, the invention is shown and described with reference to particular embodiments of the invention, but the form, quantity, and other details of the foregoing embodiments can be varied in many ways by a person skilled in the related art without departing from the technical concept and scope of the present invention.

Therefore, because the foregoing description of specific shapes, quantities, and other details is given by way of example for easily understanding the invention and does not limit the invention, any description using these parts from which these shape, quantity, and other limitations are removed in part or in full are included in the scope of the invention.

The entire disclosure of Japanese Patent Application Nos: 2006-275848, filed Oct. 6, 2006 and 2007-023365, filed Feb. 1, 2007 are expressly incorporated by reference herein.

What is claimed is:

1. A display device comprising:

a frame having a substantially cylindrically shaped cylindrical part;

a display panel that is band shaped and flexible;

a spacer that is substantially cylindrically shaped and is fit to the cylindrical part; and a battery that is the drive power source for the display panel, the display panel being is disposed to the outside surface of the spacer, the display panel being disposed around substantially the entire circumference on the outside surface of the spacer, end parts of the display panel in the circumferential direction being disposed separated by a prescribed distance, the battery being disposed between the end parts of the display panel.

2. The display device described in claim 1, further comprising a cover member that covers at least the battery.

3. The display device described in claim 2, further comprising a cover member position indication part for positioning the cover member disposed to the display panel, wherein the cover member position indication part is displayed when positioning the cover member.

4. The display device described in claim 2, further comprising a protruding part that is disposed to the spacer and enables positioning the cover member by contacting the cover member.

5. The display device described in claim 2, wherein the cover member has a photoelectric conversion means for converting light energy to electrical energy, and the battery is a secondary cell that stores the electrical energy output by the photoelectric conversion means.

6. The display device described in claim 1, further comprising a cylindrical transparent member is disposed to the outside surface of the display panel, wherein the frame has a body and a cover part, the body includes the cylindrical part and a flange part that projects to the outside from one axial end side of the cylindrical part, the cover part is flat, has an opening that is the same size and the same shape as the shape of the end part of the cylindrical part, has an outside circumference shape that is the same size and the same shape as the outside circumference shape of the flange part, and is removably attached to the other end of the cylindrical part opposite the flange part, the transparent member is held between the flange part and the cover part, and the battery is located between the cylindrical part and the transparent member and is disposed so that the battery is movable toward the cover part and replaced by removing the cover part.

7. The display device described in claim 1, further comprising a cover member that covers at least the battery, and a cylindrical transparent member is disposed to the outside surface of the display panel, wherein the frame includes a body and a cover part, the body includes the cylindrical part and a flange part that projects to the outside from one axial end side of the cylindrical part, the cover part is flat, has an opening that is the same size and the same shape as the shape of the end part of the cylindrical part, has an outside circumference shape that is the same size and the same shape as the outside circumference shape of the flange part, and is removably attached to the other end of the cylindrical part opposite the flange part, the spacer and the transparent member are held between the flange part and the cover part, and the cover member is covered by the transparent member.

8. The display device described in claim 1, wherein the spacer is not contiguous in one part in the circumferential direction and is elastically deformable.

9. The display device described in claim 1, further comprising a holding part that is disposed to the outside surface of the spacer and has a pair of channels for slidably holding each lengthwise end part of the display panel, wherein the display panel is held with substantially the middle part between the lengthwise ends adhesively attached to the spacer and both lengthwise ends held in the holding part.

10. The display device described in claim 1, further comprising a panel abutment part that is abutted by one lengthwise end of the display panel disposed to an outside surface of the spacer, and a gap that connects an inside with the outside of the spacer and enables inserting the other lengthwise end of the display panel.

11. The display device described in claim 1, further comprising a protruding part that is disposed projecting to the outside on the outside surface of the cylindrical part of the frame, and a groove that holds the protruding part and is disposed to the inside circumference surface of the spacer at a position corresponding to the protruding part.

12. The display device described in claim 11, wherein the frame includes a body and a cover part, the body includes the cylindrical part and a flange part that projects to the outside from one axial end side of the cylindrical part, a plurality of the protruding parts are disposed to the other axial end side of the cylindrical part and a screw hole is formed in each of the protruding parts, and the cover part is flat, has holes formed at positions corresponding to each of the screw holes, and is secured by screws on the other end side of the cylindrical part where the protruding parts are formed so that the cover part opposes the flange part.

* * * * *